US005947619A

United States Patent [19]

Kurashina et al.

[11] Patent Number: 5,947,619

[45] Date of Patent: Sep. 7, 1999

[54] TAPE PRINTER CAPABLE OF PRINTING A BACKGROUND AND TEXT ON THE TAPE

[75] Inventors: Hiroyasu Kurashina; Takeshi Hosokawa, both of Nagano; Kenji Watanabe, Tokyo; Takanobu Kameda, Tokyo; Tomoyuki Shimmura, Tokyo; Chieko Aida, Tokyo, all of Japan

[73] Assignees: Seiko Epson Corporation; King Jim Co., Ltd., both of Tokyo, Japan

[21] Appl. No.: 08/847,968

[22] Filed: Apr. 22, 1997

[30] Foreign Application Priority Data

Apr. 23, 1996 [JP] Japan ..... 8-101736

[51] Int. Cl.[6] ..... B41J 11/26

[52] U.S. Cl. ..... 400/615.2; 400/76; 400/61

[58] Field of Search ..... 400/83, 615.2, 400/61, 76

[56] References Cited

U.S. PATENT DOCUMENTS 5,393,147 2/1995 Ueno ..... 400/615.2

FOREIGN PATENT DOCUMENTS 63-251250 10/1988 Japan ..... 400/615.2
4246569 9/1992 Japan .
776147 3/1995 Japan ..... 400/615.2

*Primary Examiner*—Edgar Burr
*Assistant Examiner*—Charles H. Nolan, Jr.
*Attorney, Agent, or Firm*—Loeb & Loeb LLP

[57] ABSTRACT

A background pattern print image-forming method and device are provided. A plurality of kinds of unit background pattern image data formed of a dot matrix which defines a group of image-forming dots representative of a unit printing portion of a background pattern to be printed on a printing object are stored in a memory device. One kind of unit background pattern image data from the plurality of kinds of unit background pattern image data stored in the memory device is selected as a unit background pattern tile. The selected unit background pattern tile is read from the memory device, and modified to thereby form a different kind of unit background pattern image data from the selected one kind of unit background pattern image data. The different kind of unit background pattern image data is arranged in a manner such that the background pattern is formed, to thereby form background pattern print image data.

17 Claims, 25 Drawing Sheets

FIG. 9

| LEVEL | LEVEL 1 | LEVEL 2 | LEVEL 3 | LEVEL 4 | LEVEL 5 |
|---|---|---|---|---|---|
| TITLE | 文章書式___ | SELECT AT LEVEL 1 | SELECT AT LEVEL 2 | SELECT AT LEVEL 3 | SELECT AT LEVEL 4 |
| OPTIONS | _地紋印刷 | _ なし00<br>_■■名前01<br>⋮<br>_■■名前09<br>_■■名前10 | (NONE) | | |
| | | _文字地紋 | (SPECIAL INPUT SCREEN) | | |
| | | _■_創作_ | _拡大■__ | _小柄■■_<br>_大柄■■_ | _名前01■■<br>⋮<br>_名前10■■<br>_外字_■■<br>_文字_■■ |
| | | | _配置■__ | _指定■■_<br>_単位■■_ | |
| | | | __A■__ | (なし) | |
| | | | __B■__ | __左■■_<br>__右■■_ | |
| | | | __C■__ | _左上■■_<br>_右上■■_<br>_左下■■_<br>_右下■■_ | |
| | _定長印刷 | _しない<br>_A4ファイル<br>_B5ファイル<br>_5.25FD<br>_3.5FD | _■■前寄せ<br>_■■中寄せ<br>_■■割付け<br>_■■後寄せ | | |
| | | | | | |
| | _余白 ※ | _なし<br>_少なめ | _自動少なめ<br>_ふつう | _自動多め<br>_多め | _極少 |
| | _終わり？ | | | | |

TAPE PRINTER CAPABLE OF PRINTING A BACKGROUND AND TEXT ON THE TAPE

BACKGROUND OF THE INVENTION

1. Field of the Invention

This invention relates to a background pattern print image-forming method and device for forming print image data of a background pattern which is printed on a printing object material, such as a tape, by a printing apparatus.

2. Prior Art

Conventionally, in the background pattern print image-forming method and device of the above-mentioned type, first, a character string formed of letters, symbols or the like (hereinafter referred to as "the background pattern character string") is entered as a source of a background pattern, by the keyboard or other data input means, and character image data items corresponding to respective characters of the background pattern character string are read from font data stored in a read only memory (ROM) or the like, to thereby form data of a unit background pattern (hereinafter referred to as "unit background pattern image data") in which the character image data items are arranged in order. Then, in a manner corresponding to a background pattern (hereinafter referred to as "character background pattern") in which background pattern character strings are arranged in order as unit background patterns, items of the unit background pattern image data are arranged repeatedly or in succession to thereby form background pattern print image data.

In conventional printing apparatuses to which the prior art of the background print image-forming method and device is applied, a character string (hereinafter referred to as "subject writing character string") to be printed against the background pattern is entered to form subject writing character string print image data, which is then superimposed on the background pattern print image data to form print image data. By the use of the print image data, e.g. as shown in FIG. 25, subject writing character strings (e.g. each formed of kanji characters "文字地紋" (pronounced as "mo-ji-ji-mon") are printed against the character background pattern (e.g. formed by unit background patterns of the background pattern character string formed of Japanese hirakana characters "ぢもん" (pronounced as "ji-mon")).

However, in the conventional printing apparatus, a background pattern character string entered via the keyboard or the like is used as the unit background pattern. This permits only limited kinds of images to be utilized, which are defined as font data or the like. Further, the size of each character and the arrangement or juxtaposition of unit background patterns are fixed, which permits preparation of only a monotonic background pattern. Therefore, it is impossible for the user to form background pattern print image data of a desired pattern or design, and dress a colored tape, for example, by printing the desired design or pattern thereon.

To overcome such inconvenience, a background pattern print image-forming device is proposed e.g. by Japanese Laid-Open Patent Publication (Kokai) No. 63-251250, in which nonstandard character patterns originally made by the user and standard character patterns stored in the device are selectively used as unit patterns of the background pattern in a desired combination to thereby form a background pattern.

However, this device is only capable of forming the background pattern by simple combination of nonstandard character patterns and standard character patterns, so that the freedom of creation of a background pattern is still lower than demanded, and if a background pattern which is unique or with variety is desired, the nonstandard character pattern itself has to be largely changed.

SUMMARY OF THE INVENTION

It is a first object of the invention to provide a background pattern print image-forming method which is capable of forming background pattern print image data in which patterns entered or selected by the user are more flexibly arranged.

It is a second object of the invention to provide a background pattern image-forming device which is capable of forming background pattern print image data in which patterns entered or selected by the user are more flexibly arranged.

To attain the first object, according to a first aspect of the invention, there is provided a background pattern print image-forming method, which comprises the steps of:

storing a plurality of kinds of unit background pattern image data formed of a dot matrix which defines a group of image-forming dots representative of a unit printing portion of a background pattern to be printed on a printing object, in a memory device;

selecting one kind of unit background pattern image data from the plurality of kinds of unit background pattern image data stored in the memory device, as a unit background pattern tile;

reading the selected unit background pattern tile from the memory device, and modifying the unit background pattern tile read from the memory device to thereby form a different kind of unit background pattern image data from the selected one kind of unit background pattern image data; and arranging the different kind of unit background pattern image data in a manner such that the background pattern is formed, to thereby form background pattern print image data.

To attain the second object, according to a second aspect of the invention, there is provided a background pattern print image-forming device, comprising:

unit background pattern-storing means for storing a plurality of kinds of unit background pattern image data formed of a dot matrix which defines a group of image-forming dots representative of a unit printing portion of a background pattern to be printed on a printing object, in a memory device;

unit background pattern-designating means for selecting one kind of unit background pattern image data from the plurality of kinds of unit background pattern image data stored in the memory device, as a unit background pattern tile;

unit background pattern image-forming means for reading the selected unit background pattern tile from the memory device, and modifying the unit background pattern tile read from the memory device to thereby form a different kind of unit background pattern image data from the selected one kind of unit background pattern image data; and background pattern print image-forming means for arranging the different kind of unit background pattern image data in a manner such that the background pattern is formed, to thereby form background pattern print image data.

According to the background pattern print image-forming method and device of the present invention, a plurality of kinds of unit background pattern image data are stored in a memory device, and one of them is selected and read from the memory device as a unit background pattern tile. The unit background pattern tile can be modified to form a different kind of unit background pattern image data, which is then arranged such that the background pattern is formed, whereby a new kind of background pattern image data can be produced. Therefore, the present method and device makes it possible to create a variety of unit background pattern image data items through selecting a desired one of the plurality of kinds of unit background pattern imaged data and modifying the selected one. This increases the freedom of the user's composition of a background pattern, and hence enables him to print a desired background pattern on a printing object.

Preferably, the background pattern print image-forming method further includes the step of forming the unit background pattern image data based on dot image data entered.

Similarly, the background pattern print image-forming device includes entry/creating means for forming the unit background pattern image data based on dot image data entered.

According to these preferred embodiments, it is possible to enter a unit background pattern as a dot image as desired, to thereby form unit background pattern image data which corresponds to a unit of background pattern print image data. Therefore, by selecting the unit background pattern image data as the unit background pattern tile, it is possible to form background pattern image data which presents a desired background pattern.

Preferably, the step of forming the different kind of unit background pattern image data includes the step of extracting a portion of the unit background pattern tile to thereby form the different kind of unit background pattern image data.

Similarly, the unit background pattern image-forming means comprises extraction/creating means for extracting a portion of the unit background pattern tile to thereby form the different kind of unit background pattern image data.

According to these preferred embodiments, it is possible to select one kind of unit background pattern image data as a unit background pattern tile and extract a portion of the unit background pattern tile to thereby form a new kind of unit background pattern image data. That is, from a composite pattern of the unit background pattern image data, new unit background pattern image data representative of a simple pattern can be formed. Such a composite pattern can be stored for extraction of a desired pattern therefrom as required, whereby not only freedom of creation of unit background pattern image data can be increased, but also the capacity of the memory device and the like can be saved.

Preferably, the step of forming the different kind of unit background pattern image data includes the step of reading the unit background pattern tile from the memory device by the use of an image-expanding dot set formed of a dot matrix consisting of a plurality of image-forming dots arranged in at least one of a vertical direction, a horizontal direction, and a diagonal direction, and remaining dots arranged as blank dots, thereby arranging the image-expanding dot set in a manner corresponding to an arrangement of image-forming dots of the unit background pattern tile to thereby form the different kind of unit background pattern image data.

Similarly, the unit background pattern image-forming means includes expansion/creating means for reading the unit background pattern tile from the memory device by the use of an image-expanding dot set formed of a dot matrix consisting of a plurality of image-forming dots arranged in at least one of a vertical direction, a horizontal direction, and a diagonal direction, and remaining dots arranged as blank dots, thereby arranging the image-expanding dot set in a manner corresponding to an arrangement of image-forming dots of the unit background pattern tile to thereby form the different kind of unit background pattern image data.

According to these preferred embodiments, one kind of unit background pattern image data is selected as a unit background pattern tile, and an image-expanding dot set in which a plurality of image-forming dots are arranged in predetermined directions is arranged in a manner corresponding to each of image-forming dots of the unit background pattern tile, whereby a new item of unit background pattern image data can be obtained which is varied in density or size of the image. For example, when an image-expanding dot set having four (2×2) dots all set as image-forming dots is used, it is possible to obtain a new item of unit background pattern image data just four times as large in size as its original unit background pattern tile. Further, if an image-expanding dot set having two image-forming dots arranged diagonally is selected, there is formed a background pattern print image which is light as a whole, since only two of the four dots thereof are set as image-forming dots. When this background pattern is printed, a subject writing character string can be presented clear against its background.

Preferably, the image-expanding dot set comprises image-forming dots and blank dots arranged in a manner alternating with each other in a column and/or in a row.

According to this preferred embodiment, an image-expanding dot set based on a checkered dot matrix is employed. By arranging this image-expanding dot set in correspondence to each location of image-forming dots of a unit background pattern tile, it is possible to vary the impression of the background pattern, e.g. such that a light or pale impression is imparted thereto.

Preferably, by the use of two kinds of dot matrices of an odd-numbered column image-expanding dot set in which image-forming dots are arranged diagonally from an upper right location to a lower left location and an even-numbered column image-expanding dot set in which image-forming dots are arranged diagonally from an upper left location to a lower right location, the odd-numbered column image-expanding dot set is arranged in a manner corresponding to each of image-forming dots on each odd-numbered column of the unit background pattern tile, and the even-numbered column image-expanding dot set is arranged in a manner corresponding to each of image-forming dots on each even-numbered column of the unit background pattern tile, thereby forming the different kind of unit background pattern image data.

Similarly, the expansion/creating means arranges, by the use of two kinds of dot matrices of an odd-numbered column image-expanding dot set in which image-forming dots are arranged diagonally from an upper right location to a lower left location and an even-numbered column image-expanding dot set in which image-forming dots are arranged diagonally from an upper left location to a lower right location, the odd-numbered column image-expanding dot set in a manner corresponding to each of image-forming dots on each odd-numbered column of the unit background pattern tile, and the even-numbered column image-expanding dot set in a manner corresponding to each of image-forming dots on each even-numbered column of the unit background pattern tile, thereby forming the different kind of unit background pattern image data.

According to these preferred embodiments, by arranging a herringbone pattern of image-expanding dot set in correspondence to each of image-forming dots of a unit background pattern tile, it is possible to vary appearance of a background pattern such that the background pattern appears light but dressed-up.

Preferably, the step of storing the different kind of unit background pattern image data includes the steps of:

selecting one kind of unit background pattern image data from the plurality of kinds of unit background pattern image data stored in the memory device, as an arrangement-designating matrix; and arranging the unit background pattern tile in a manner corresponding to a location of each of image-forming dots of the arrangement-designating matrix to thereby form the different kind of unit background pattern image data.

Similarly, the unit background pattern image-forming means includes:

arrangement-designating matrix-selecting means for selecting one kind of unit background pattern image data from the plurality of kinds of unit background pattern image data stored in the memory device, as an arrangement-designating matrix; and arrangement-designating/creating means for arranging the unit background pattern tile in a manner corresponding to a location of each of image-forming dots of the arrangement-designating matrix to thereby form the different kind of unit background pattern image data.

According to these preferred embodiments, after selecting one kind of unit background pattern image data as an arrangement-designating matrix and selecting another kind of unit background pattern image data as a unit background pattern tile, the unit background pattern tile is arranged in a manner corresponding to each location of image-forming dots of the arrangement-designating matrix, whereby it is possible to form a variety of new items of unit background pattern image data. For example, by selecting unit background pattern image data of a complicated pattern as the arrangement-designating matrix, it is possible to form more complicated unit background pattern image data based on the complicated pattern of the selected unit background pattern image data. Further, when the arrangement-designating matrix is defined by data of dotted image, it is possible to set an arrangement of unit background pattern tiles freely or as desired. That is, by selecting data of a unit background pattern tile of a desired pattern, and designating an arrangement of the background pattern tiles by the use of an arrangement-designating matrix, freely or as desired, it is possible to dress a background pattern with a degree of freedom by far higher than when conventional methods are used.

The above and other objects, features, and advantages of the invention will become more apparent from the following detailed description taken in conjunction with the accompanying drawings.

BRIEF DESCRIPTION OF THE DRAWINGS

FIG. 9 is a diagram showing a list enumerating menu options for selection at each menu presented in the FIG. 7 format-selecting/setting processing;

DETAILED DESCRIPTION

The invention will now be described in detail with reference to the drawings showing embodiments thereof.

Figure 1:
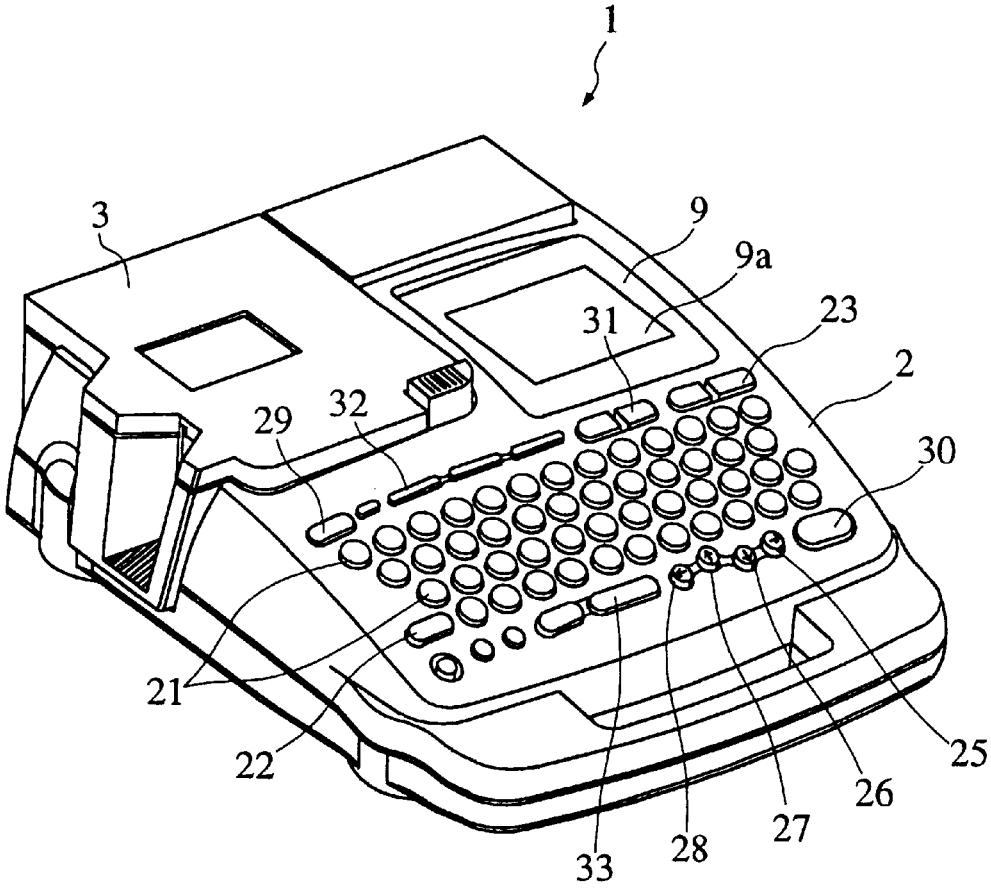
FIG. 1 is a perspective view showing an appearance of a tape printing apparatus incorporating a background pattern print image-forming device according to an embodiment of the invention.

Referring first to FIG. 1, there is shown the whole arrangement of a tape printing apparatus 1 incorporating a print image-forming device according to an embodiment of the invention. The printing apparatus 1 includes a keyboard 2 arranged on a front-side portion of a top thereof, a liquid crystal display 9 arranged in a right-side rear portion of the same, and a lid 3 mounted on a left-side rear portion of the same. The liquid crystal display 9 has a display screen 9*a* which is capable of displaying a line number and four lines each formed by six characters at the maximum, in a mode of normal text display.

Arranged on the keyboard 2 are a character key group 21 including alphabet keys and number keys, and a function key group for designating various operation modes. The function key group includes a shift key 22 for use in nonstandard character registration described hereinafter, a delete key 23 for clearing entry errors or the like, four cursor-moving keys 25, 26, 27 and 28 for moving a cursor in respective rightward (→), downward (↓), upward (↑), and leftward (←), directions, a print key 29, a selection key 30 for selecting modes and feeding lines during text entry, a symbol key 31 for selectively entering symbols and figures already registered and registering or calling a nonstandard character, a format key 32 for designating a background pattern, fixed length print, a margin, and a conversion key 33 for kana character-kanji character conversion during text entry, etc.

Figure 2:
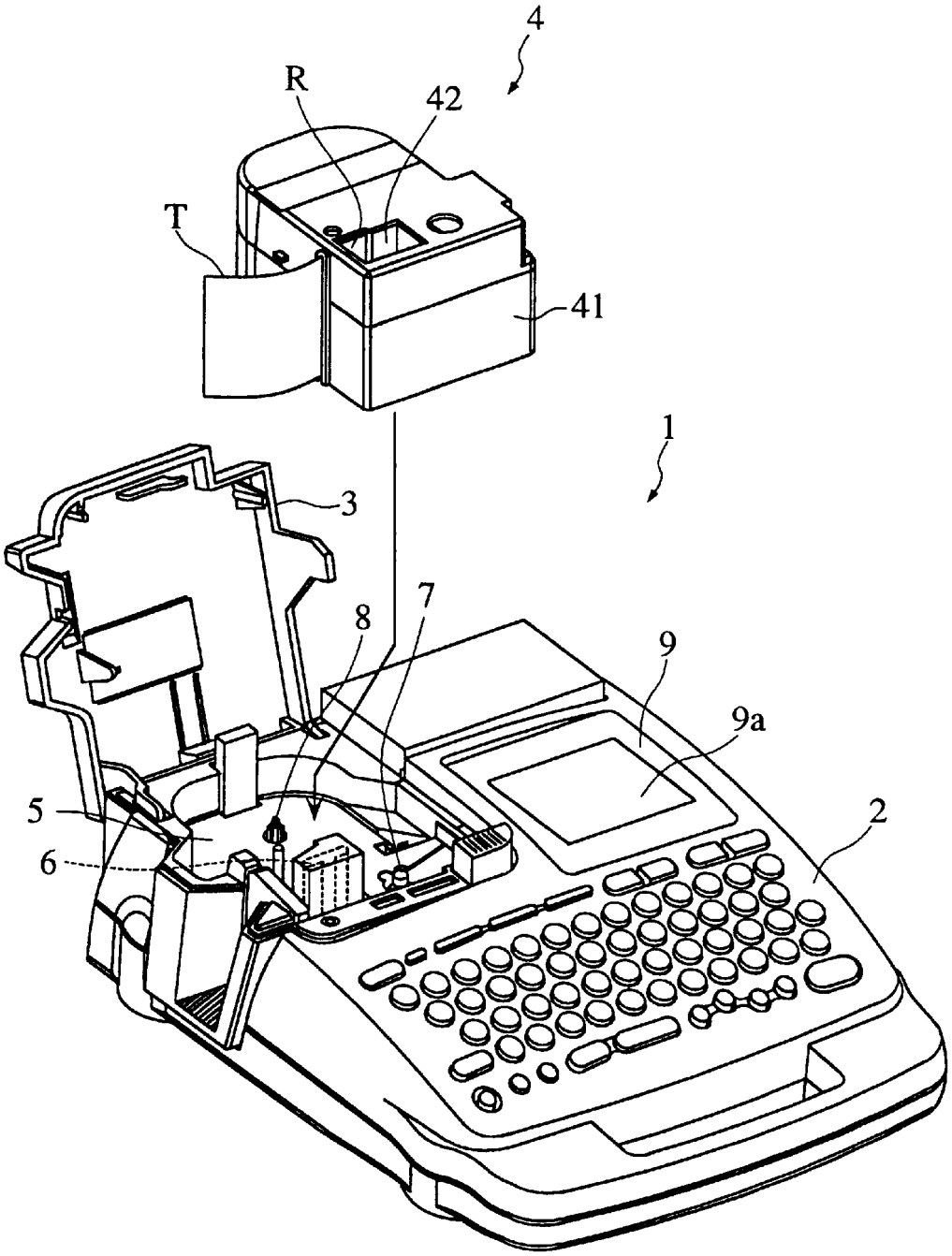
FIG. 2 is a perspective view showing the FIG. 1 tape printing apparatus with its lid open, and a tape cartridge removed therefrom.

As shown in FIG. 2, arranged under the lid 3 is a loading block 5 for loading a tape cartridge 4 therein. The tape cartridge 4 contains a recording medium (tape) T having a fixed width. The tape T has an adhesive surface on the reverse side which is covered with a peel-off paper. The tape cartridge 4 contains an ink ribbon R together with the tape T. The tape T and the ink ribbon R are fed or run such that they pass by a window 42 in a state lying one upon another, and the tape T alone is delivered out of the apparatus, but the ink ribbon R is taken up into a roll within the tape cartridge 4.

The loading block 5 has a thermal head 6 arranged therein, which abuts the reverse side of the ink ribbon R exposed to the outside from the window 42 of the tape cartridge 4 when the tape cartridge 4 is loaded in the loading block 5. Then, by driving the thermal head 6 while heating the same, desired letters and the like are printed on the surface of the tape T. Further, the loading block 5 is provided with drive shafts 7 and 8 for engagement with driven portions of the tape cartridge 4 loaded in the loading block 5. These drive shafts 7 and 8 cause the tape T and the ink ribbon R to be fed or carried in the tape cartridge 4.

Figure 3:
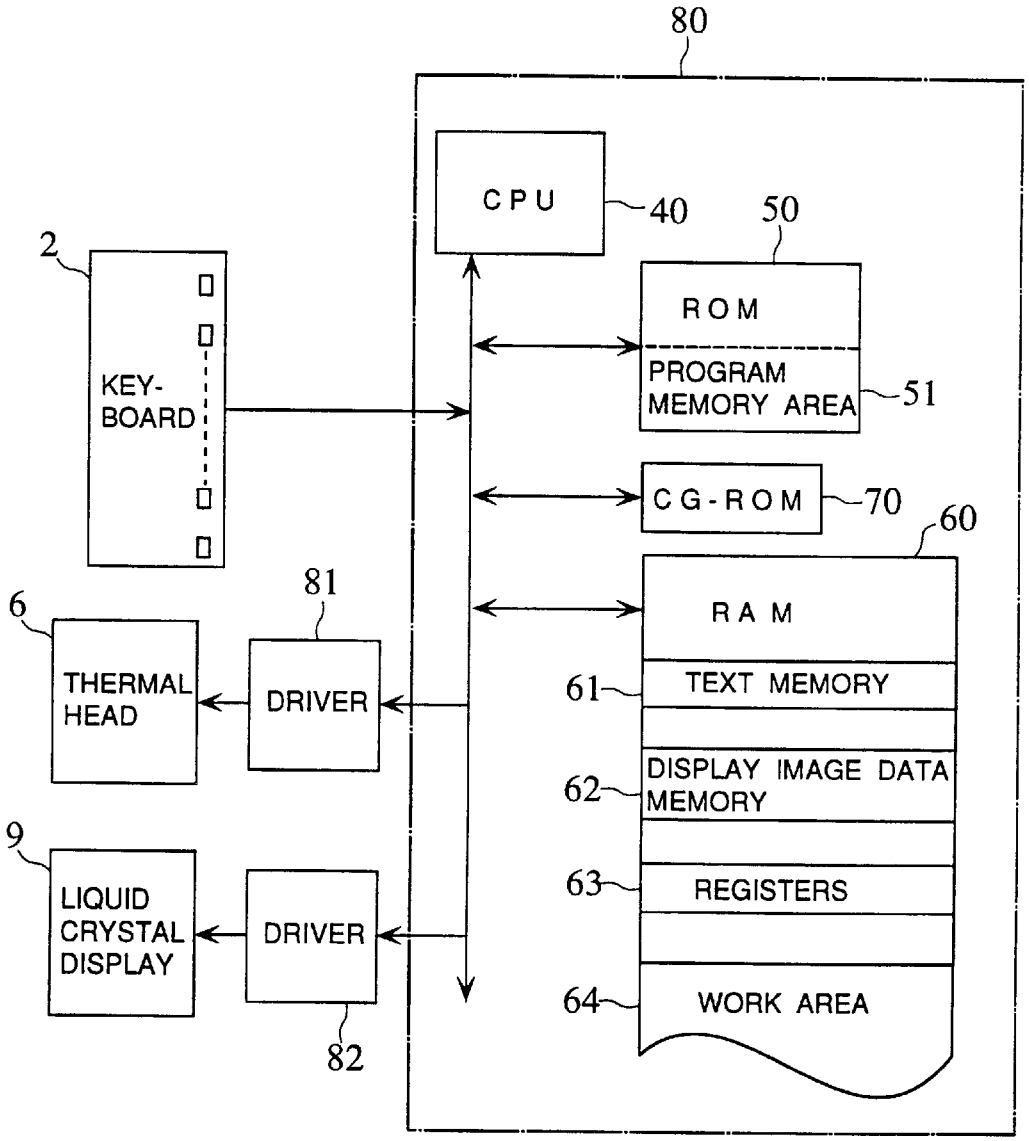
FIG. 3 is a block diagram schematically showing a control system of the FIG. 1 printing apparatus.

Next, referring to FIG. 3, a control system of the tape printing apparatus 1 will be described. The control system includes a control circuit 80 comprised of a CPU 40, a read only memory (ROM) 50, a random access memory (RAM) 60, and a character generator ROM (hereinafter referred to as "CG-ROM") 70. The control circuit 80 has its input port connected to the keyboard 2, and its output port connected to the thermal head 6 via a driver 81 for driving the same, and the liquid crystal display 9 via a driver 82 for driving the same for display operation.

The ROM 50 has a program memory area 51 storing control programs for controlling the thermal head 6 and the liquid crystal display 9, and various programs for processing operations, described hereinafter. The RAM 60 includes a text memory 61 for temporarily storing text data of letters and symbols entered via the keyboard 2, a displayed image data memory 62 for storing image data corresponding to contents displayed on the display screen 9*a* of the liquid crystal display 9, a register group 63 for temporarily storing results of processing by the CPU 40, a work area 64 for forming image data and the like in various kinds of processing described hereinafter. The RAM 60 is backed-up during the power OFF, and is capable of restoring entered text data, created/registered image data, and saved values of registers to respective states before the power is turned off. The CG-ROM 70 stores font data of letters and symbols provided for the tape printing apparatus 1, and outputs corresponding font when code data specifying a letter is given thereto.

Next, overall processing carried out by the tape printing apparatus 1 will be described with reference to FIG. 4 et. seq. Procedures of processing for basic operations of moving the cursor by the cursor key 25 etc., and other operations responsive to input via the function keys, which are not directly related to the present invention, will be collectively shown as "PROCESSING RESONSIVE TO OTHER FUNCTION KEYS" (S13) and detailed description thereof will be omitted.

Figure 4:
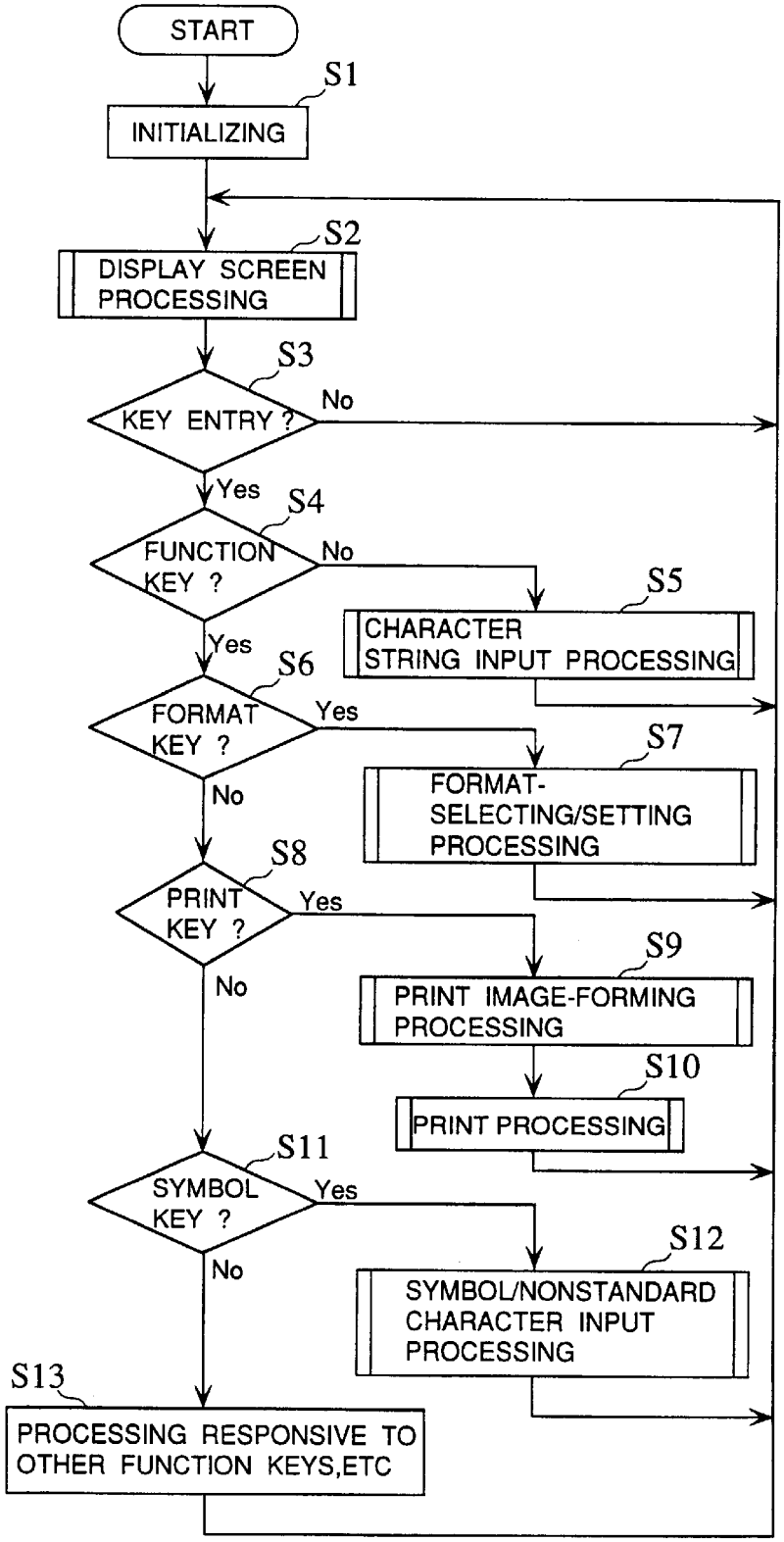
FIG. 4 is a flowchart showing overall control processing executed by the FIG. 1 tape printing apparatus.

Referring to FIG. 4, when the present processing is started, first, at a step S1, initialization of the system, such as restoring of saved control flags, is carried out to restore the tape printing apparatus 1 to a state before the power is turned off. Then, display screen setting is carried out at a step S2. For explanation purposes, the following description will be made assuming that the system is initialized to display a normal character string entry screen in a key entry wait sate. Alternatively, it may be assumed that the present state is immediately after the shift key 22 and the delete key 23 are depressed at the same time, i.e. in combination, to delete text data displayed on the screen and display the normal character string entry screen in its key entry wait state, since the tape printing apparatus 1 is configured to operate in this manner.

When the keyboard display processing (S2) is terminated, it is determined at a step S3 whether or not a key entry has been made. If no key entry has been made (No to S3), then the display screen processing is executed again (S2). That is, the looped processing causes the same screen to be continuously displayed until another key entry is carried out. If a character key (alphabet key) is depressed in this state, it is determined that a key entry has been made (Yes to S3), and it is determined at a step S4 that the key entry has not been made by a function key (No to S4), so that the character string entry processing is carried out at a step S5.

In the character string entry processing (S5), for example, when a Japanese hirakana character "あ" (pronounced like "a" of "at") is entered, the text data "あ" is taken into the text memory 61, and font data corresponding thereto is read from the CG-ROM 70. The reverse image data of Japanese hirakana characters "あ" is stored at a location of display image data corresponding to the position of the cursor stored in the display image data memory 62, whereby when the display screen processing (S2) is carried out next time, the Japanese hirakana character "あ" is displayed in reverse video indicating that the entered data is not determined or settled for entry.

Then, when the selection key 30 is depressed to determine or settle the entry of the Japanese hirakana character "あ" it is determined at the step S3 that a key entry has been made, and at the step S4 that the key entry has been made by a function key. Then, it is determined at a step S6 that the operated function key is not the format key 32, at step S8 that the same is not the print key 29, and at a step S11 that the same is not the symbol key 31, followed by determining or settling the entry of the Japanese hirakana character "あ". In other words, the data of image data of the Japanese hirakana character "あ" in reverse video within the display image data memory 62 is changed into normal image data. As a result, when the display screen processing (S2) is carried out again, the character "あ" is displayed in normal video or as a normal image.

Figure 5:
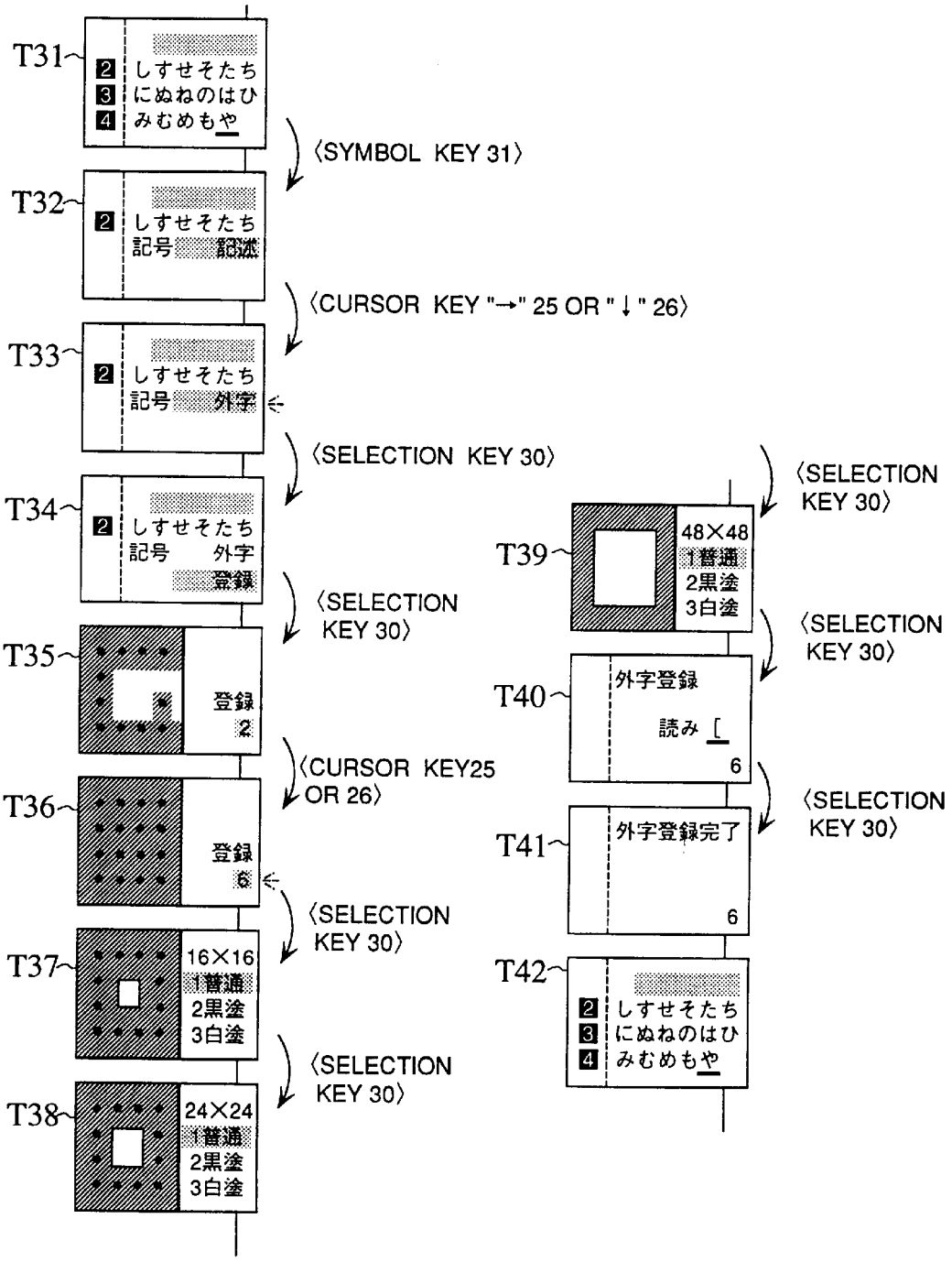
FIG. 5 is a diagram showing examples of contents displayed on the screen, which are useful in explaining processing of symbol/nonstandard character registration executed in the FIG. 4 control processing.

Similarly, when each character key of the character key group 21 is depressed to enter Japanese hirakana characters "あいうえおかきくけこ" (pronounced as "a-i-u-e-o-ka-ki-ku-ke-ko") as a first line, Japanese hirakana characters "さしすせそたちつてと" (pronounced as "sa-si-su-se-so-ta-ti-tu-te-to") as a second line, . . . , Japanese hirakana characters "まみむめもや" (pronounced as "ma-mi-mu-me-mo-ya) as a fourth line, so that the Japanese hirakana characters "あいう～めもや" are entered 10 letters per line, results of entries are displayed as shown on a screen T31 shown in FIG. 5. (Hereafter, contents displayed on the display screen 9*a* are referred to as "screen T??" (? represents a digit) and shown in the figure with the same reference numeral.) In this connection, in the character string entry processing (S5), when entries of Japanese hirakana characters "あい" ("a-i") are made, by depressing the conversion key 33 before determining or settling the entries, the hirakana characters "あい" can be converted to a kanji character "愛", which is pronounced as "ai" and means "love". In short, a kanji entry can be made as well.

Then, when the print key 29 is depressed in the state of the above screen T31 being displayed, it is determined at the step S3 that a key entry has been made, that the key entry has been made by a function key (Yes to S4), that the operated function key is not the format key 32 (No to S6), and that the operated function key is the print key 29 (Yes to S8). Then, the print image-forming processing is carried out to form print image data, and based on the print image data, printing is carried out at a step S10, followed by displaying the screen in a key entry wait state.

In the print image-forming processing (S9), first, the font data corresponding to each character of the character string (subject writing character string) of the entered text data is read from the CG-ROM 70, and developed into a location corresponding to a position of each character of the character string within an area for subject writing character string print image data of the work area 64, to thereby form subject writing character string print image data. If background pattern print image-forming processing (S72) in FIG. 8 has been carried out to form background pattern print image data, the above subject writing character string print image data is superimposed on the background pattern print image data to form print image data, whereas if no background pattern print image data is formed, the subject writing character string print image data is directly outputted as print image data (actually, in this case as well, print image data is formed by superposing the subject writing character string print image data on blank character pattern image data).

On the other hand, if the symbol key 31 is depressed in the state of the screen T31 being displayed, it is determined at the step S3 that a key entry has been made, that the key entry has been made by a function key (Yes to S4), that the operated function key is not the format key 32 (No to S6), that the operated function key is not the print key 29 (No to S8), and at a step S11 that the operated function key is the symbol key 31. Then, symbol/nonstandard character entry processing (S12) is carried out.

In the symbol/nonstandard character entry processing (S12) and format-selecting/setting processing (S7) described hereinafter, the above character string entry processing (S5) and the display screen processing (S2) are also set to respective modes for designated processing. Therefore, in the following description, so long as the processing is not related to a display screen, description will be made with reference to flowcharts, whereas if it is related to a display screen, description will be made with reference to figures illustrating changes in the contents displayed on the screen, in a manner associated with the character string entry processing (S5) and the display screen processing (S2) therefor.

Referring to FIG. 5, in the state of the screen T31, when the symbol key 31 is depressed, the symbol/nonstandard character input processing (S12) is started as described above. More specifically, first, there is played a menu (menu options) for this processing, thereby permitting selection of one of the menu options (screen T32). That is, there are displayed an option "記述" (which means "description") for permitting selection of any of Japanese descriptive symbols such as "、", "○", ". . . ", etc. an option "算数" (which means "arithmetic") for permitting selection of any of symbols for arithmetic expressions, such as "×", "÷", "=", and a menu option "○Δ□☆" for permitting selection of any of popular standard symbols, such as "○", "◎", and "◆" an option "外字" (which is pronounced as "gaiji" and means "non-standard character") for permitting selection of the option of nonstandard character registration/calling, etc. One of these menu options is displayed in reverse video or highlighted by placing the cursor thereon through operating any of the cursor-moving keys 25 to 28 (hereafter, these cursor-moving keys will be referred to as the cursor key "→" 25, the cursor key "↓" 26, the cursor key "↑" 27, and the cursor key "↓" 28), and then by depressing the selection key 30, the selection of the one displayed in reverse video is determined.

In the following, description will be made of a case where the option "外字" (nonstandard character) is selected, which enables the same function for the unit background pattern-designating/creating processing of the format-selecting/setting processing (S7), described in detail hereinafter. As shown in FIG. 5, immediately after the symbol key 31 is depressed, there appears a screen in which the option selected or accessed on the immediately preceding occasion, e.g. "記述" (description) is displayed in reverse video (screen T32; hereinafter "screen" before the reference numeral T?? will be omitted). From this state, the cursor key "→" 25, or the cursor key "↓" 26 may be continually depressed to cause the "外字" (nonstandard character) to be displayed in reverse (T33). Options presented under "外字" (nonstandard character) are "登録" (registration), "修正" (modification), "呼出" (calling), "複写" (copy), and "削除" (deletion). Here, a case of selecting the menu option "登録" (registration) will be described, the function enabled under this option being also used in the format-selecting/setting processing (S7), described in detail hereinafter.

As shown in FIG. 5, on the screen T34, the "登録" (registration) is displayed in reverse video as the option accessed or selected last time, and when the selection key 30 is depressed, a nonstandard character-registering screen is displayed, where data of a nonstandard character plotted by dotted image under 登録2 (Registration No. 2), which is accessed last time, is shown (T35). In the nonstandard character-registering screen, there are displayed vertexes of each rectangular area in 16×16 dots by respective large dots against a background in reverse video (i.e. as a negative image), thereby showing squares in units of 16×16 dot-areas. On the display screen, there are displayed 4×4=16 large dots, and the maximum 48×48 dots can be displayed. However, as shown on the screen T35, plotted portions of a dotted image of registered nonstandard character data and plotted areas displayed during plotting of a dotted image are shown in normal video (as a positive image) (see T37).

Then, when the option "登録" (registration No. 6) is selected by operating the cursor key "→" 25, or the cursor key "↓" 26 for new registration of a nonstandard character, a nonstandard character-entering screen is displayed. First, a plotting area of 16×16 dots is displayed in the center (T37). At this time, the plotting cursor appears at an upper right vertex of the plotting area, and by operating the cursor-moving keys 25 to move the cursor leftward, rightward, upward or downward, together with a cross guide for easy perception of the plotting cursor, a dotted image can be plotted. At a right side of this plotting screen, there are displayed menu options to be selected during plotting, and on top of the menu options, there are shown coordinates of the present position of the cursor based on an origin set to an lower right vertex of the plotting area.

As menu options of the menu for nonstandard character registration, there are displayed 1 "普通" (normal filling), 2 "黒塗" (black filling), (3) "白塗" (white filling), which are selected by pushing number keys of "1", "2", and "3", respectively. When the option 1 "普通" (normal filling) is selected, whenever the shift key 22 is pushed, the dot at a position of the cursor is displayed in an alternately reversed manner between black and white, i.e. alternately in a positive dot and a negative dot. When the option 2 "黒塗" (black filling) is selected, a start point for black dots is displayed at a position of the cursor where the shift key 22 is pushed, and as the cursor is moved, a rectangular area of black dots (black-filled area) having a diagonal line connecting the start point and the present position of the cursor is expanded or contracted, until the shift key 22 is depressed second time to fixedly determine the black-filled area. Then, the state of "普通" (normal filling) is restored. When the option (3) "白塗" (white filling) is selected, it is possible to carry out the processing in a manner identical to the above case of the option (2) being selected except that black dots for filling are replaced by white dots. Escape from the plotting mode can be effected by depressing the delete key 23 or the symbol key 31, whereupon the screen returns to the selection screen T36 at the immediately upper level.

When plotting of dotted images in a plotting area of 16×16 dots is terminated by depressing the selection key 30, nonstandard character data plotted in a matrix of 16×16 dots is registered, and then the screen is switched to a plotting screen which displays a plotting area of 24×24 dots as shown in T38. Within the plotting area, nonstandard character data obtained by converting the nonstandard character data entered in a matrix of 16×16 dots to a matrix of 24×24 dots is displayed. When an image plotted in a smaller number of dots is directly expanded to an image in a larger number of dots, irregularities of curved portions of the image become more noticeable. This inconvenience is overcome by correcting the curved portions into more finely defined curved potions by plotting in the same manner as carried out in plotting in the matrix of 16×16 dots. When the selection key 30 is depressed thereafter, the resulting nonstandard character data plotted in 24×24 dots is registered, and then the screen is switched to a plotting screen displaying a plotting area of 30×30 dots.

If the selection key 30 is depressed after correction of images is carried out for image data items of 30×30 dots, 36×36 dots, and 48×48 dots (T39) in the same manner as described above, there appears a screen (T40) for guiding entry of a name for created nonstandard character data by "読み[" which means "reads [". When Japanese hirakana characters "みつば" (pronounced as "mi-tu-ba" meaning "three-leaf"), for example, are entered by operating corresponding character keys, and then the selection key 30 is depressed, a message "外字登録完了" notifying that nonstandard character registration is completed is displayed (T41), and the character string entry screen (T42) is displayed again.

If the symbol key 30 is depressed in this state, for example, the screen T34 shown in FIG. 6 (identical to the screen T34 in FIG. 5) is displayed by way of the screens T32 and T33 described with reference to FIG. 5. From this screen, by depressing the cursor key "→" 25 or cursor key "↓", "呼出" (calling) can be displayed in reverse video (T51), and then by depressing the selection key 30 (and by operating the cursor key "→" 25 or the cursor key "↓" 26 on the resulting screen T52, assuming that "登録2" (registration No. 2) is accessed or selected on the immediately preceding occasion), a nonstandard character-calling screen T53 is displayed in which "登録6" (registration No. 6) for nonstandard character is called. In this screen, there is displayed image data of 48×48 dots of the nonstandard character registered as registration No. 6, which can be e.g. image data of an image G531 of a three-leafed figure (clubs).

Next, from this screen, when the selection key 30 is depressed, a message "外字呼出実行" notifying execution of the nonstandard character calling is displayed (T54), and then an image of called data, e.g. the image G531 of the three-leafed figure is inserted at the cursor position of the original screen T31 to thereby display the character string entry screen (T55) again.

Figure 10:
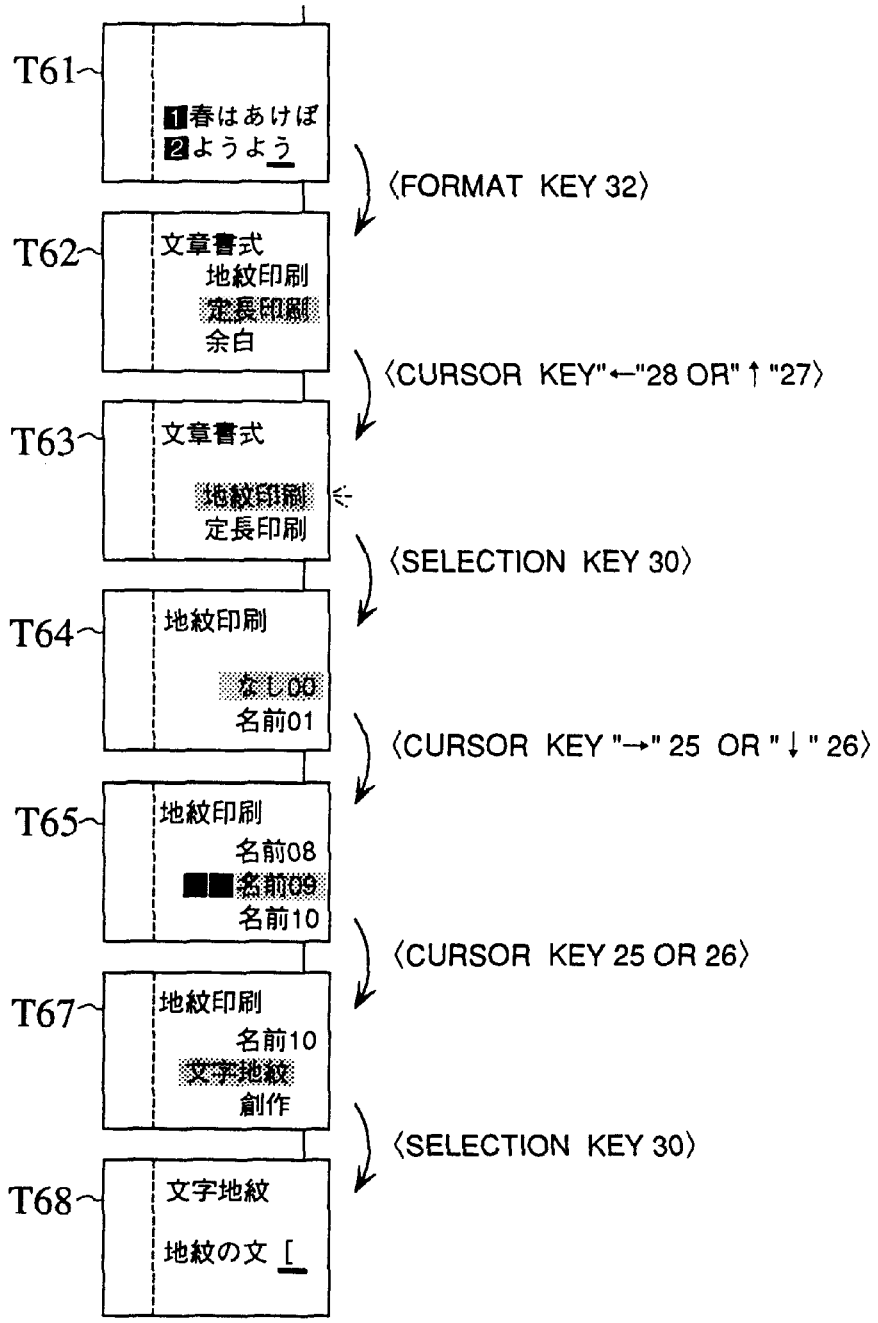
FIG. 10 is a diagram showing examples of contents displayed on the screen, which are useful in explaining unit background pattern-designating/creating processing in the FIG. 7 format-selecting/setting processing, which is started when an option "文字地紋" (character background pattern) is selected at level 2 under an option "地紋印刷" (background pattern printing) selected at level 1 in the FIG. 9 menu list.

Next, the format-selecting/setting processing (S7) embodying a characteristic feature of the invention will be described. For example, when the format key 32 is depressed in a state where the character string entry screen, e.g. a screen T61 in FIG. 10, is displayed, it is determined at the step S3 that a key entry has been made, and then it is determined that the operated key is a function key (Yes to S4). After determining that the operated function key is the format key 32 (Yes to S6), the format-selecting/setting processing is carried out at the step S7. After termination of this processing, the screen again returns to a screen T74 in FIG. 11 (identical to T61 in FIG. 10) which corresponds to the step S2 in FIG. 4.

Figure 7:
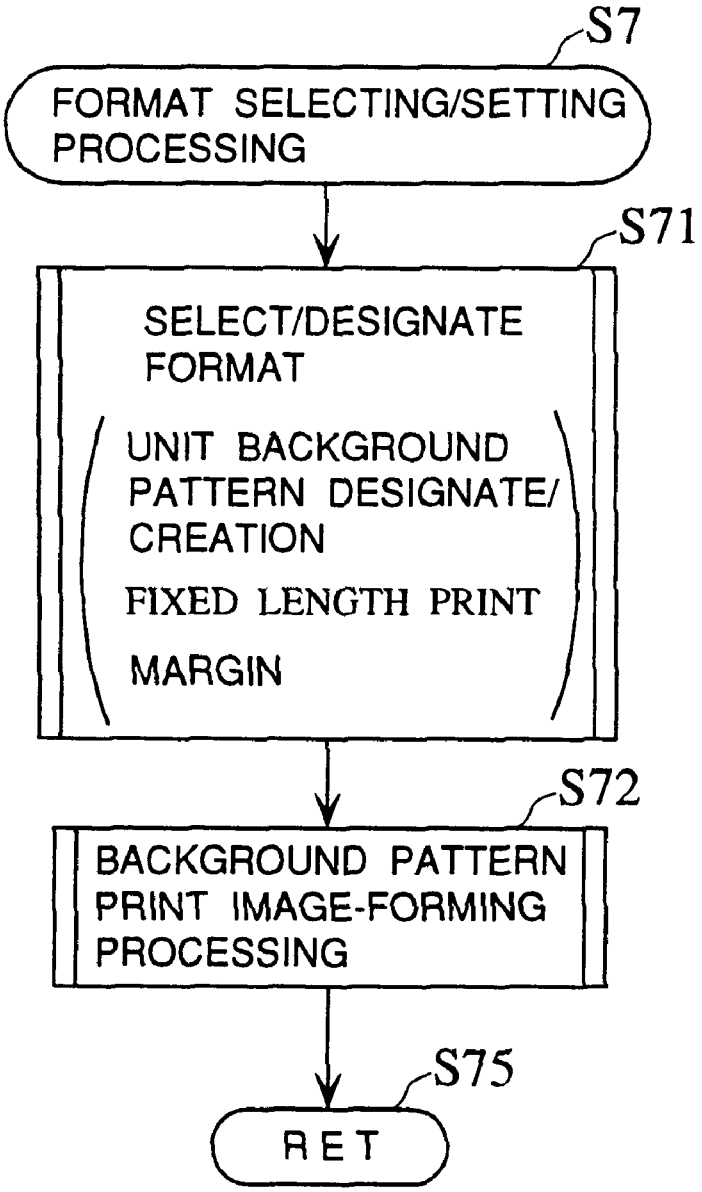
FIG. 7 is a flowchart showing format-selecting/setting processing executed in the FIG. 4 control processing.

Referring to FIG. 7, in the format-selecting/setting processing (S7), first, the format-selection/designation is carried out at a step S71. In this processing, on the display screen, in the same manner as an option is selected in the symbol/nonstandard character entry processing (S12) described with reference to FIG. 5, it is possible to select one of the following options: an option of unit background pattern-designating/creating processing for designating unit background pattern image data for use in forming background pattern print image data through selection of one of ready-made items of unit background pattern image data, or for newly creating the same in a manner described hereinafter with reference to FIGS. 9 to 24D, an option of fixed length print-designating processing for setting the length of a print area on the tape T to a predetermined value, and an option of margin-designating processing for designating a margin of the print area on the tape T. Upon termination of the format selection/designation (S71), the background pattern print image-forming processing (S72) in FIG. 7 is carried out, followed by terminating the format-selecting/setting processing (S75).

Now, description will be first made of the background pattern print image-forming processing (S72) executed in a manner subsequent to the option of the unit background pattern-designating/creating processing executed in the format-selecting/setting processing (S71).

Figure 8:
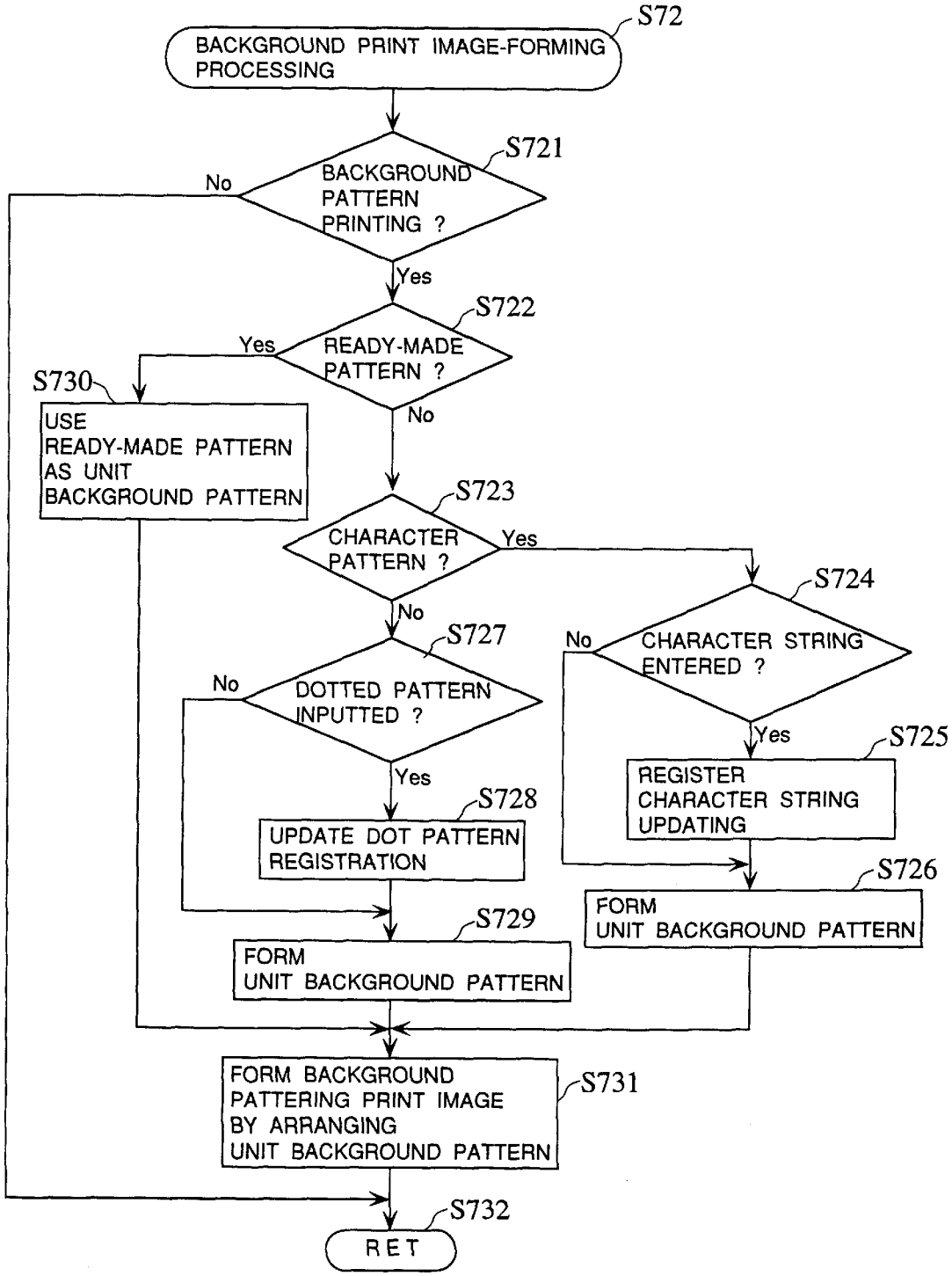
FIG. 8 is a flowchart of background pattern print image-forming processing executed in the FIG. 7 processing.

Referring to FIG. 8, when the background pattern print image-forming processing (S72) is started, it is first determined at a step S721 whether or not the printing of a background pattern is designated. When the printing of a background pattern is not designated in the unit background pattern-designating/creating processing (No to S721), the processing is immediately terminated (S732). If the answer to the question of the step S721 is affirmative (Yes to S721), it is then determined at a step S722 whether or not a ready-made background pattern is designated. If the ready-made background pattern is designated (Yes to S722), image data of the designated background pattern is set ready for use as the unit background pattern image data at a step S730. If no ready-made background pattern is designated (No to S722), it is then determined at a step S723 whether or not a character background pattern is designated.

If it is determined at the step S723 that a character background pattern is designated, it is determined a step S724 whether or not a character string (background pattern character string) has been entered. If the background pattern character string has been entered (Yes to S724), text data of the newly-entered background pattern character string is registered at a step S725 in place of text data of a background pattern character string used on the immediately preceding occasion for forming the background pattern print image, and then the program proceeds to a step S726, wherein the text data of the newly-registered background pattern character string is used to read font data corresponding thereto from the CG-ROM 70, whereas if no background pattern character string is entered (No to S724), the program immediately proceeds to the step S726, wherein the text data of the background pattern character string registered on the immediately preceding occasion is used to read font data corresponding thereto from the CG-ROM 70. The font data thus read is developed into image data, forming unit background pattern image data for a character background pattern.

Figure 14:
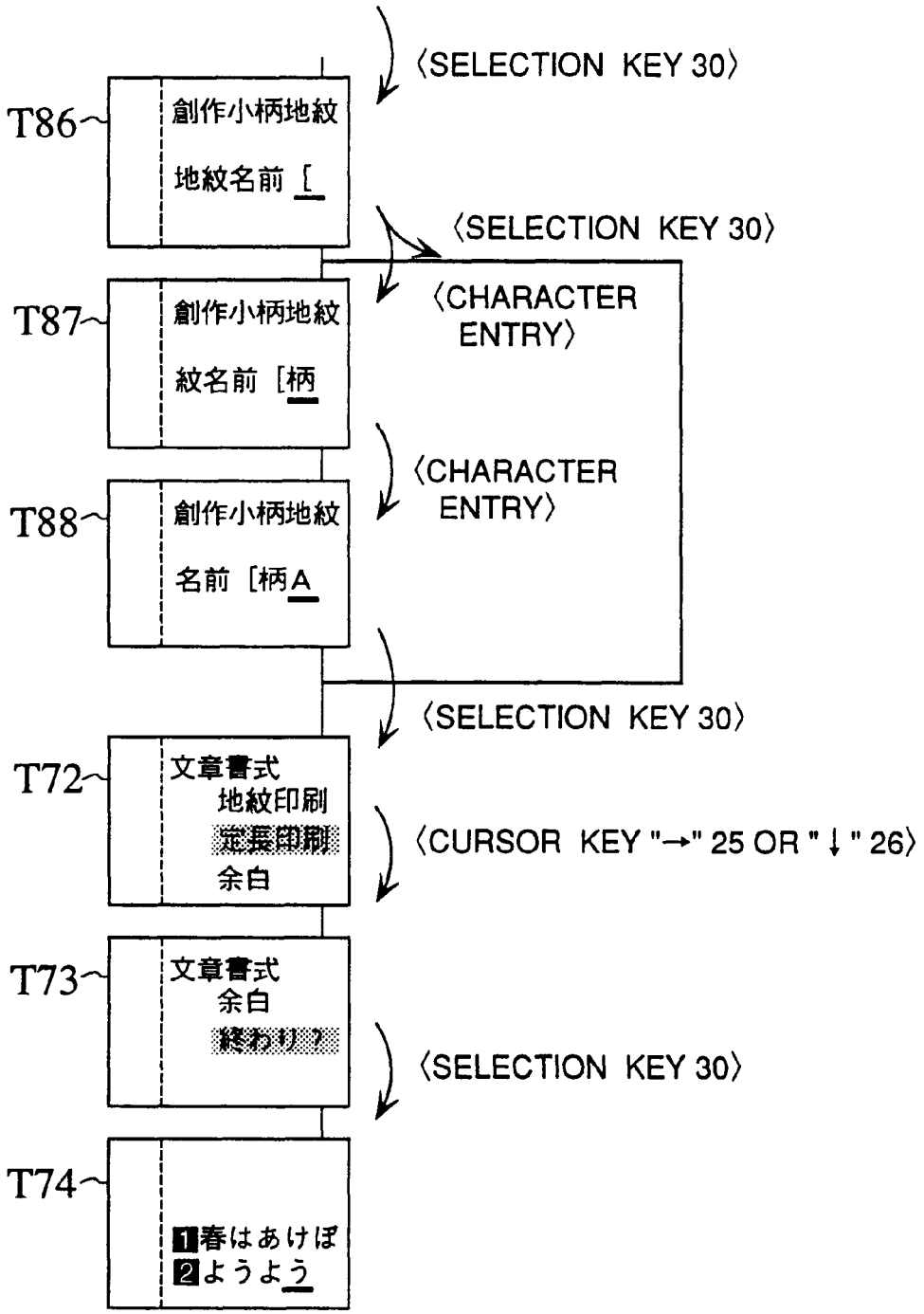
FIG. 14 is a diagram similar to FIG. 10, which is useful in explaining continued part of the FIG. 13 processing.

When the unit background pattern image data has been formed, an input screen is displayed for entering a name of the unit background pattern to register the unit background pattern image data as a ready-made unit background pattern image data item (as shown in T86 to T88 in FIG. 14). If registration of the new unit background pattern image data is desired, it can be effected by entering a name therefor and then depressing the selection key 30, whereby the unit background pattern-forming processing (S726) is terminated, and the screen returns to the original screen. On the other hand, if the registration (S726) is not desired, the unit background pattern-forming processing is terminated by depressing the selection key 30 without entering the name, and the screen returns to the original screen.

On the other hand, if the character background pattern has not been designated (No to S723), i.e. if an option of creative background pattern has been designated, then it is determined at a step S727 whether or not data of an image plotted as a dotted image similarly to the nonstandard character registration (hereinafter, data of an image plotted as a dotted image will be referred to as "dot pattern") has been entered. If the dot pattern entry has been carried out (Yes to S727), the newly-entered dot pattern is registered in place of the dot pattern registered on the immediately preceding occasion of forming the background pattern print image by the option of creative background pattern.

The registration of the dot pattern (S728) means that the dot pattern is registered into an area storing a dot pattern for use in the background pattern print image-forming processing (S72) apart from registration of a dot pattern plotted in the unit background pattern-designating/creating processing, described hereinafter, as a ready-made unit background pattern image data item (see displayed contents T87 to T88 in FIG. 14). That is, even if the dot pattern is not registered as a ready-made background pattern, so long as updating registration of another dot pattern is not executed (S728), the data is preserved, and further, the same background pattern continues to be repeatedly printed, for different subject writing character strings, unless a different unit background pattern is designated.

Then, according to the kind of the creative background pattern designated in a manner described hereinafter, unit background pattern image data for creating a background pattern i.e. for use in a creative background pattern is formed. When the unit background pattern image data is completed, similarly to the designation of the character background pattern, an input screen is displayed for permitting entry of a name of the formed unit background pattern to register the unit background pattern image data as a ready-made unit background pattern image data item. If registration is desired, after entering the name, whereas if not, without entering the same, the selection key 30 is depressed, whereby the unit background pattern-forming processing is terminated (S726). That is, in both of the options of the character background pattern and the creative background pattern, registration of a newly-made unit background pattern as a ready-made unit background pattern image data item increases the number of kinds of ready-made items of the unit background pattern image data available for selection in the unit background pattern-designating/creating processing, described hereinafter.

When any of the ready-made background pattern, the character background pattern, and the creative background pattern is designated, the designated unit background pattern image data is arranged to form background pattern print image data at a step S731, followed by terminating the background pattern print image-forming processing (S732). Background pattern print image data items to be formed in this processing will be described in detail based on examples therefor in the description of the unit background pattern-designating/creating processing. Further, as described with reference to FIG. 4, in the print image-forming processing (S9), the subject writing character string print image data is superimposed on the background pattern print image data formed in the above processing, whereby the print image data is formed, and at the following print processing (S10), the printing is carried out based on the print image data.

Next, the format-selecting/designating processing (S71) will be described with reference to FIG. 9 et seq. FIG. 9 shows a list of menus presented during the format-selecting/designating processing (S71). In the FIG. 9 menus, shaded menu options, e.g. "定長印刷" (fixed length printing) at level 1 shows an option selected by default. Further, "定長印刷" (fixed length printing) and "余白" (margin) of the menu at level 1 do not bear direct relationships with the present invention, and therefore, detailed description thereof is omitted but only the names are referred to if necessary in describing selected screens in the process.

Now, referring first to FIG. 9 and FIGS. 10 to 12, an example of the unit background pattern-designating/creating processing executed when the option of the character background pattern is designated will be described. Referring to FIG. 10, when a character string of kanji and/or kana characters in Japanese language, such as "春はあけぼ . . . " has been entered and displayed on a subject writing character string entry screen (T61), if the format key 32 is depressed, there appears a screen of "文書形式" (writing format) in which the menu at the level 1 shown in FIG. 9 is displayed. Since the menu option selected by default at the level 1 is "定長印刷" (fixed length print), immediately after the format key 32 is depressed, "定長印刷" (fixed length print) is displayed in reverse video or highlighted (T62). In this state, if the cursor key "←" 28 or the cursor key "↑" 27 is depressed, "地紋刷" (background pattern printing) is displayed in reverse video (T63). If the selection key 30 is depressed, the menu at level 2 under the option "地紋刷" (background pattern printing) is displayed.

On a screen T64 where "なし00" (none 00) is for selection by default, the cursor key "→" 25 of the cursor key "↓" 26 is depressed to display "名前01" (name 01), "名前02" (name 02)", . . . , "名前09" (name 09), "名前10" (name 10), "文字地紋" (character background pattern) in reverse video, one after another, (T65 to T67), and in the state of display of "文字地紋" (character background pattern) in reverse video or in a highlighted state, if the selection key 30 is depressed, there is displayed a screen at level under the option "文字地紋" (character background pattern) shown in FIG. 9, i.e. a special input screen T68 for entering a character string (background pattern character string) for a character background pattern. On the screen T68, under the title of "文字地紋" (character background pattern) at a first line, there is displayed a guide of "地紋の文[" which means "string of background pattern [" at a third line.

Figure 11:
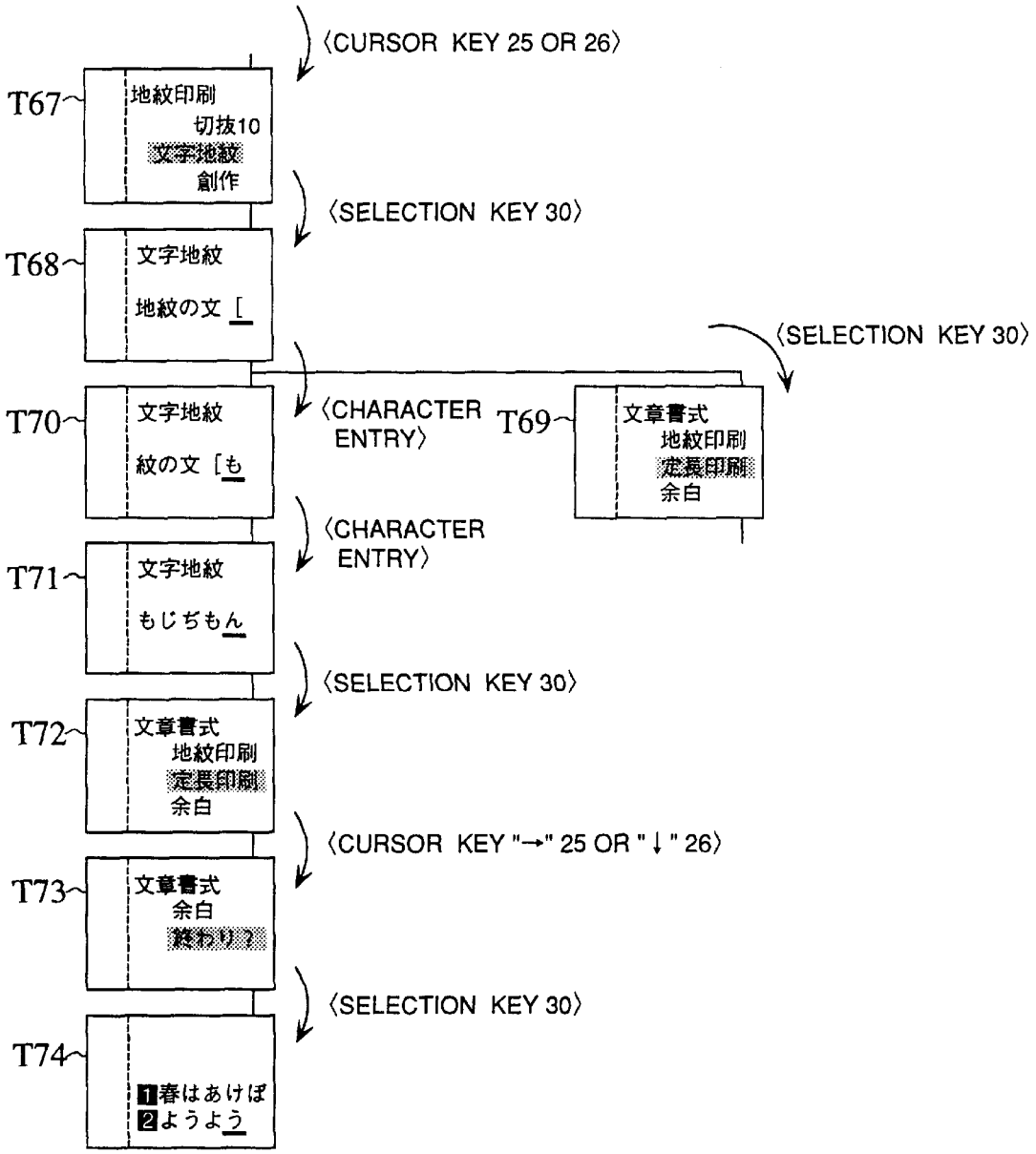
FIG. 11 is a diagram similar to FIG. 10, which is useful in explaining processing continued from the FIG. 10 processing.

Referring to FIG. 11 (screens T67 to T68 are common to FIG. 10), in a state where no character string is entered on the screen T68, if the selection key 30 is depressed, the screen returns to the screen T69 at level 1 shown in FIG. 9 which is one level higher. On the other hand, if a Japanese hirakana character string of "もじぢもん" is entered after "[" of the guide where the cursor is positioned (T70 to T71), and then the selection key 30 is depressed, the character string "もじぢもん" is registered as a background pattern character string, and then the menu at level 1 in FIG. 9 higher by one level is displayed (T72). From the screen T72, if the cursor key "→" 25 or the cursor key "↓" 26 is continually depressed until "終わり?" which means "end?" is displayed in reverse video (T73), and then the selection key 30 is depressed, the original subject writing character string entry screen (T74) is displayed again.

In this case, immediately after the selection key 30 is depressed on the screen T73 in FIG. 11, the background pattern print image processing (S72) in FIG. 8 described hereinbefore is carried out to form background pattern print image data for the character background pattern (S731), whereby the format-selecting/setting processing (S7) in FIG. 7 is terminated. Then, by the display screen processing (S2) in FIG. 4, the above-mentioned screen T74 is displayed.

Figure 12A:
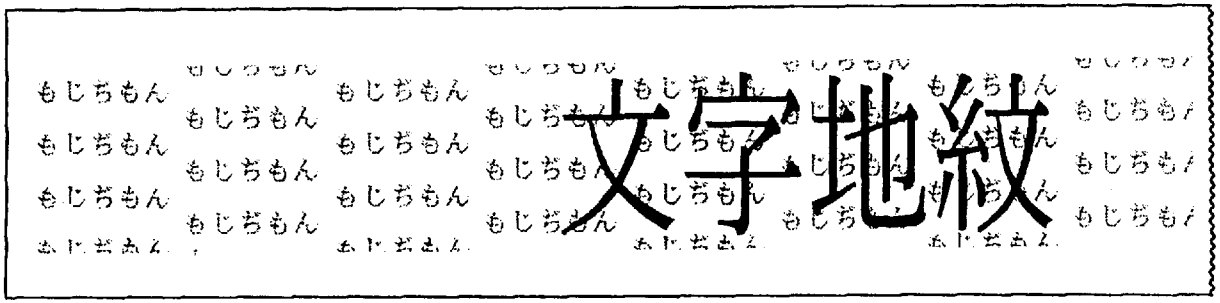
FIGS. 12A to 12C show examples of results of printing of a background pattern carried out after execution of the FIGS. 10–11 processing.

Therefore, on the screen T74, if the original displayed subject writing character string "春はあけぼ . . . " is deleted, e.g. by depressing the shift key 22 and the delete key 23 in combination, and after entering kanji characters "文字地紋" as a new subject writing character string, the print key 29 is depressed, the print image-forming processing (S9) is carried out to form print image data in which the subject writing character string print image data of "文字地紋" is superimposed on the background pattern print image data of the character background pattern formed using the background pattern character string image data as unit background pattern image data, and then the print processing (S10) is carried out based on the print image data, to complete a tape T as shown in FIG. 12A.

Figure 12B:
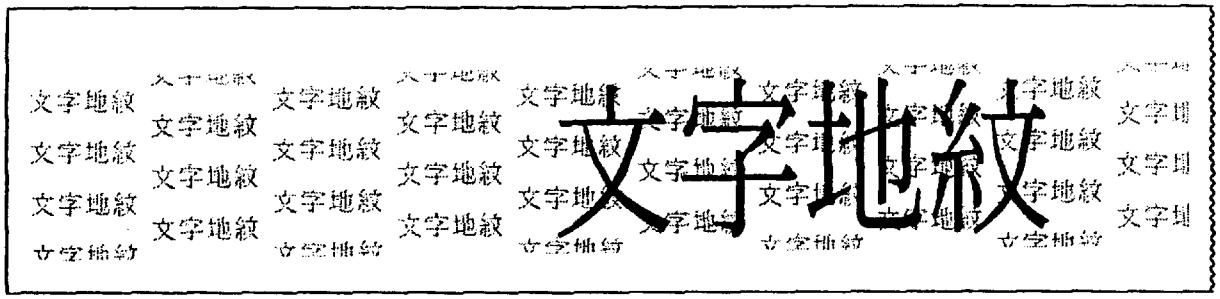
Figure 12C:
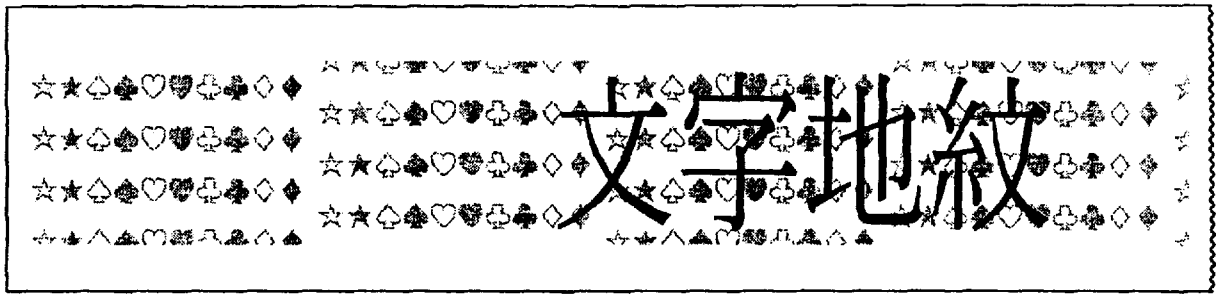

FIG. 12B shows an example of results of printing using the background pattern character string of "文字地紋" obtained by converting the Japanese hirakana characters "もじぢもん" to kanji characters by operating the conversion key 33, instead of entering the hirakana characters "もじぢもん" as the background pattern character string "もじぢもん" on the screens T70 to T71 in FIG. 11. Further, FIG. 12C shows an example of results of printing using a background pattern character string formed by entering and juxtaposing symbols and figures in the same manner as described hereinbefore as to the symbol/nonstandard character entry processing (S12) with reference to FIG. 4.

Next, when a ready-made unit background pattern image data item is designated as unit background pattern image data, in the same manner as described with reference to the screens T64 to T67 in FIG. 10, on the screen for selecting an option of the menu at level 2 shown in FIG. 9, the name of a ready-made background pattern to be designated, e.g. "名前09" (name 09) is caused to be displayed in reverse video (T65), and then by depressing the selection key 30, the unit background pattern image data of "名前09" (name 09) is selected as the designated unit background pattern image data. It should be noted that the description is made assuming that ten items having respective names of "名前01" (name 01) to "名前10" (name 10) are registered as ready-made unit background pattern image data items. The "名前??" (name ??) can be made as desired in the unit background pattern-forming processing (S726) described hereinbefore with reference to FIG. 8, or when the screens T86 to T88 in FIG. 14, referred to hereinafter, are displayed so that the number of registered data items is also changed with execution of such registration of an additional ready-made unit background pattern image data item.

In the case described above, when the option "名前09" (name 09) is selected (T65), and the selection key 30 is depressed, the menu at level 1 in FIG. 9 (identical to screen T72 in FIG. 11) is displayed. Similarly to the case of the character background pattern, "終わり?" (end?) is displayed in reverse video or highlighted and the selection key 30 is depressed, whereby the designated ready-made unit background pattern image data item is juxtaposed to form background pattern print image data (S731 in FIG. 8), followed by displaying the original subject writing character string entry screen (identical to screen T74 in FIG. 11). Then, after the subject writing character string is entered, when the print key 29 is entered, the subject writing character string print image data is superimposed on the background pattern print image data to form print image data (S9 in FIG. 4), based on which printing is carried out at the step S10 in FIG. 4.

Figure 13:
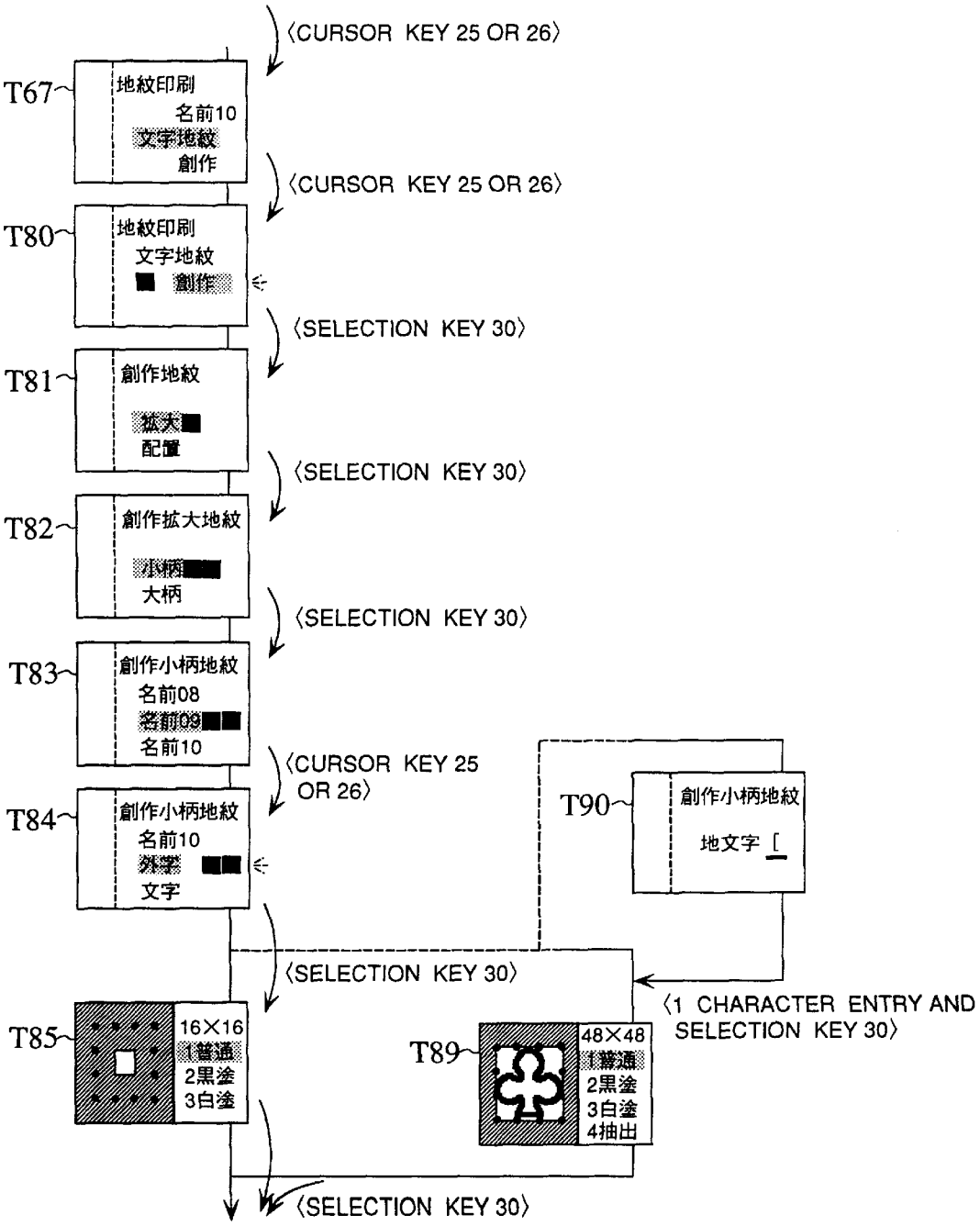
FIG. 13 is a diagram similar to FIG. 10, which is useful in explaining processing executed when the option "創作地紋" (creative background pattern) is designated.

Next, the unit background pattern-designating/creating processing executed when the creative background pattern is designated will be described with reference to FIG. 9, and FIGS. 13 to 16. As shown in FIG. 13, when the "文字地紋" (character background pattern) is displayed in reverse video as an option of the menu at level 2 in FIG. 9 on the screen T67 (the same as shown in FIG. 10 or FIG. 11), the cursor key "→" 25 or the cursor key "↓" 26 is depressed to thereby cause an option "創作" (creative) to be displayed in reverse video, and then the selection key 30 is depressed to display the menu at level 3 under the option "創作" (creative) in FIG. 9. In the displayed menu of "創作地紋" (creative background pattern), the menu option accessed on the immediately preceding occasion, e.g. "拡大" (expansion) is displayed in reverse video (T81).

Now, the description will be first made of a case where the creative small pattern is designated at level 4 under the creating background pattern under the option "創作" (creative) shown at level 2 in FIG. 9. In the state of the screen T81 in FIG. 13 in which "拡大" (expansion) is displayed in reverse video, by depressing the selection key 30, there appears a screen displaying the menu at level 4 under the options "創作" (creative expansion) at level 2 and "拡大" (expansion) at level 3 shown in FIG. 9, in which an option "小柄" (small pattern) selected on the immediately preceding occasion is displayed in reverse video (T82). If an option "大柄" (large pattern) is an option selected or accessed on the immediately preceding occasion, the option "大柄" (large pattern) is displayed in reverse video, and therefore, by operating the cursor key "↑" 27 or cursor key "←" 28, the "小柄" (small pattern) can be selected to be displayed in reverse video. In the state where the option "小柄" (small pattern) is displayed in reverse video on the screen T82, by depressing the selection key 30, the menu at level 5 under the option "小柄" (small pattern) shown in FIG. 9 is displayed, in which the option "名前09" (name 09) selected or accessed on the immediately preceding occasion is displayed in reverse video (T83).

Figure 15:
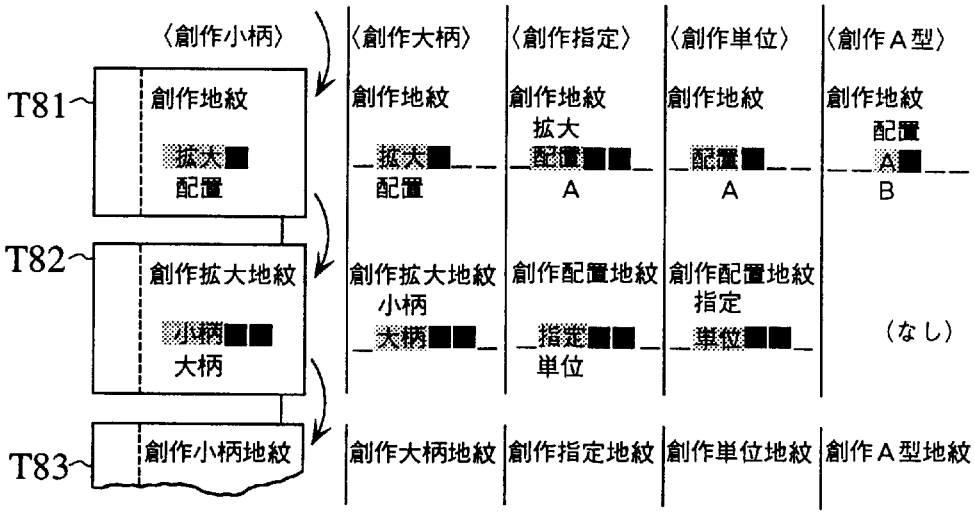
FIG. 15 is a diagram showing contents displayed on the screen for each kind of the option "創作地紋" (creative background pattern), which correspond to T81 to T83 in the FIG. 14 diagram.
Figure 16:
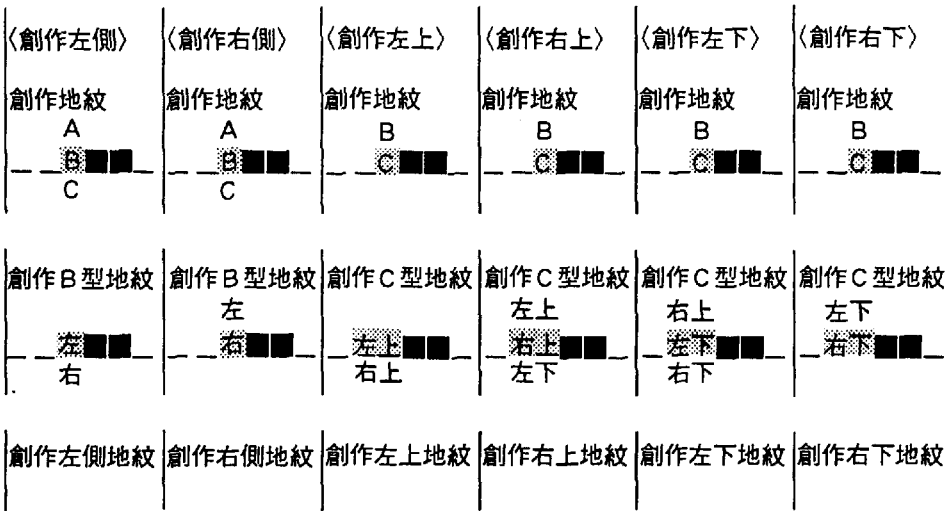
FIG. 16 is a diagram which is similar to FIG. 15 and forms continued part of the FIG. 15 diagram.

As shown in FIG. 9, from the menu at level 5, it is possible to select options common to the menu of "創作" (creative) at level 2, irrespective of selections at levels 3 and 4. In the menu screen T83 at level 5, as shown in FIGS. 15 and 16, at a first line, a title indicative of menu options selected at levels 3 and 4, e.g. "創作小柄地紋" (creative small background pattern) is displayed. That is, in the processing described hereinafter with reference to contents displayed on the screen T83 et seq. in FIGS. 13 and 14, unit background pattern image data is selected or created by the option "創作小柄" (creative small pattern). In cases where a creative background pattern other than the option "創作小柄" (creative small pattern) is designated, it is possible to select or create a corresponding kind of unit background pattern image data according to a similar procedure.

In the state where the option "名前90" (name 09), which is selected or accessed on the immediately preceding occasion, is displayed in reverse video on the screen T83 in FIG. 13, by depressing the cursor key "→" 25 or the cursor key "↓" 26 the option "外字" (nonstandard character) can be displayed in reverse video (T84), and when the selection key 30 is then depressed, the same screen as the plotting screen T36 in FIG. 5 is displayed with reference to which the nonstandard character registration is described hereinbefore. That is, on the screen T85, plotting in dotted images can be carried out in the same manner as described on the nonstandard character registration, whereby it is possible to form unit background pattern image data of "創作小柄地紋" (creative small background pattern).

However, in the plotting screen T85, by depressing the shift key 22 and the cursor key "↓" 26 at the same time, it is possible to change the screen of 16×16 dots to a plotting screen of 24×24 dots. Further, by similarly depressing the keys, it is possible to change the screen to a screen of 30×30 dots, a screen of 36×36 dots, and a screen of 48×48 dots. When the selection key 30 is depressed after data entry for plotting is effected in any of these screens displayed, differently from the case of the nonstandard character registration described hereinbefore, this does not cause a change to a plotting screen of another dot number but causes determination of the entry of the data displayed with the dot number of the screen as unit background pattern image data. Further, a change of the displayed screen in a reverse direction can be effected by depressing the shift key 22 and the cursor key "↑" 27 at the same time, and the size of a screen can be changed to 8×8 dots, and 4×4 dots in addition to the above sizes, for the ease of use e.g. in an option "創作配置" (creative arrangement), described hereinafter.

If plotting entry is effected on the screen T85 or a modification of a plotted image is effected on a screen T89, referred to hereinafter, and at the same time the selection key 30 is depressed to determine the unit background pattern image data thereof, a flag is set for making the answer to the question of the step S727 in FIG. 8 affirmative (Yes). When the selection key 30 is depressed after the image data (dot pattern) is formed by the above dotted image, the screen for entering the name of a unit background pattern is displayed for registration of the formed unit background pattern image data item as a ready-made background pattern (T86 in FIG. 14).

On the other hand, on the screen T83-T84 in FIG. 13, when any of the ready-made background pattern named "名前00" (name 00) to "名前10" (Name 10) is displayed in reverse video and the selection key 30 is depressed, a screen (T89) for modifying the plotted image is displayed. On the screen T89, the selected ready-made unit background pattern image data item is called and displayed. For example, if the image G531 in FIG. 6 is already registered as the unit background pattern image data having the name of "名前10" (name 10), the image G531 of the three-leafed figure is called and displayed (T89) by selecting "名前10" (name 10). Hereafter, similarly to this unit background image pattern data item of the three-leafed figure, a unit background pattern image data item which is already made and registered for use as a basis for forming other unit background pattern image data will be referred to as "unit background pattern tile".

In the plotted image-modifying screen T89, as shown in the figure, first, a screen of 48×48 dots is displayed. In this screen T89 as well, the displayed screen can be changed in the same manner as on the screen T85 described above. Here, the image of the ready-made background pattern is checked, and if modification of the image is not necessary, only the selection of size of the image is effected. If the modification is necessary, on the screen T89, in addition to the options of the menu displayed for selection on the screen T36 in FIG. 5 in the nonstandard character registration and the screen T85 in FIG. 13, i.e. 1 "普通" (normal filling), 2 "黒塗" (black filling), and 3 "白塗" (white filling), a menu option 4 "抽出" (extraction) can be selected by depressing a number key "4". When the option 4 "抽出" (extraction) is selected, part of the displayed image can be extracted to use the same as another unit background pattern image data item.

That is, at a position of the cursor where the shift key 22 is first depressed, a start point of black dots "white dots in the case of the background being in black dots" is displayed, and as the cursor is moved, a rectangular frame of a selected area having a diagonal line connecting the start point and the present position of the cursor is expanded or contracted, until the shift key 22 is depressed second time to fixedly determine the selected area. The displayed frame is in white dots if the background is in black dots, and in black dots if the background is in white dots, such that the displayed frame is continuous. If the range or size of the frame is determined, the image of the selected area is expanded or compressed to the size of the plotting area of the displayed screen. In this state, if the displayed screen is changed to a screen of a desired dot number by depressing the shift key 22 and the cursor key "↓" 26 or the cursor key "↑" 27, the image data adapted to the resulting screen is obtained. If the selection key 30 depressed in this state, the screen for the option 1 "普通" (normal filling) is displayed again.

After the dot pattern is formed through processing of the resulting image data, e.g. by modification, if the selection key 30 is depressed, the screen (T86 in FIG. 14) is displayed for entering the name of a unit background pattern to register the unit background pattern image data item thus produced as a ready-made background pattern.

Further, on the screen T83-T84 in FIG. 13, if the selection key 30 is depressed when "文字" (character) is displayed in reverse video, there appears a screen of "地文字" (background pattern character) for entering a background pattern character as shown in the figure as T90. In this screen T90, a guide for entry, i.e. "地文字[" ("background pattern character[") is displayed, and if one character, e.g. a Japanese hirakana character "あ" is entered at the cursor position after "[" of the guide, font data of the character ("あ") is read and developed into the plotted image-modifying screen T89. On the screen T90, it is possible to enter not only a Japanese hirakana character but also a kanji character as well as any of the alphabet and other symbols, as normally carried out for text entry. That is, developed image data of any of characters stored as font data can be modified as a source of unit background pattern image data (unit background pattern tile), and the resulting image data thus modified can be used as an unit background pattern image data item.

After the dot pattern is thus formed, when the selection key 30 is depressed, the screen (T86 in FIG. 14) for entering the name of the unit background pattern is displayed. In this state, if "柄A" (pattern A), for example, is entered as the name of the unit background pattern (T87-T88), and then the selection key 30 is depressed, the dot pattern formed is registered as a ready-made unit background pattern image data item having the name ("柄A" (pattern A)), followed by display of the menu at level 1 in FIG. 9 (the same screen T72 as in FIG. 11). On the other hand, if the selection key 30 is depressed without entering the name of the unit background pattern, the screen T72 is displayed without registering the dot pattern. However, as described hereinabove, in the background pattern print image-forming processing (S72) in FIG. 8, even if the dot pattern is not registered as the ready-made background pattern, the dot pattern-updating registration (S728) is carried out, so that the dot pattern formed reflects on the unit background pattern tile of the unit background pattern image data as a component constituting the background pattern print image data. Description of the processing executed on the screen T72 et seq. is omitted since it is the same as described concerning "文字地紋" (character background pattern) and "既製地紋" (ready-made background pattern) described hereinbefore.

As described above, in the unit background pattern-designating/creating processing executed when the option "創作地 紋" (creative background pattern) is designated at level 2 in FIG. 9, by entering one unit of a desired background pattern as a dotted image, it is possible to form unit background pattern image data. This can be named, e.g. on the screen T86 in FIG. 14, and registered as the ready-made background pattern, for an option for selection as a designated unit background pattern image data item, it is possible to form background pattern print image data in which a desired background pattern is expressed.

Further, as described with reference to the screen T89 in FIG. 14, by selecting a unit background pattern image data item in which the ready-made background pattern or font data of characters or the like is developed as the unit background pattern tile, and extracting part of the displayed data, a new unit background pattern image data item can be formed. That is, from a composite pattern of the unit background pattern image data, a new unit background pattern image data item representative of a simple pattern can be formed. This makes it possible to store only such a composite pattern for later extraction of a desired pattern therefrom as needed, whereby not only freedom of creation of unit background pattern image data can be enhanced, but also the capacity of the memory device and the like can be saved.

Next, examples of unit background pattern image data formed when the option "創作地 紋" (creative background pattern) is designated, and examples of results of printing of such data will be described, for each kind of creative background pattern.

First, when the option "創作小 柄" (creative small pattern) is designated in the unit background pattern-designating/creating processing, a selected or created unit background pattern image data item is used as a unit background pattern tile, and in the unit background pattern creation (S729) in FIG. 8, new background pattern image data obtained by expanding the unit background pattern tile is formed. As the unit background pattern tile, there is used any of a unit background pattern image data item (dot pattern) created on the screen T85 in FIG. 13, a unit background pattern image data item selected from data items of ready-made background patterns or font data of characters and the like, and a unit background pattern data item modified e.g. by extraction on the screen T89.

Figure 17A:
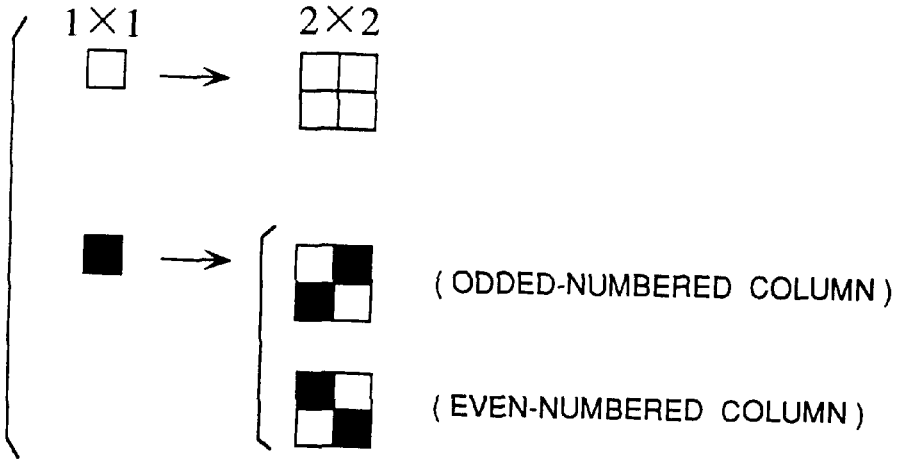
FIGS. 17A and 17B are diagrams which are useful in explaining a manner of forming unit background pattern image data, when the option "創作小柄" (creative small pattern) is designated from the menu of "創作地紋" (creative background pattern)

In the unit background pattern creation (S729) in FIG. 8 executed when the option "創作小 柄" (creative small pattern) is designated, as shown in FIG. 17A, in correspondence to each white dot (blank or background pixel) of the unit background tile in 1×1 dot, an expanded blank dot set in 2×2 dots is arranged, while in correspondence to each black dot (image-forming dot) on an odd-numbered column, an image-expanding dot set in 2×2 dots in which image-forming dots are arranged at upper right and lower left locations is arranged, and in correspondence to each black dot (image-forming dot) on an even-numbered column, an image-expanding dot set in 2×2 dots in which image-forming dots are arranged at upper left and lower right locations is arranged.

Figure 17B:
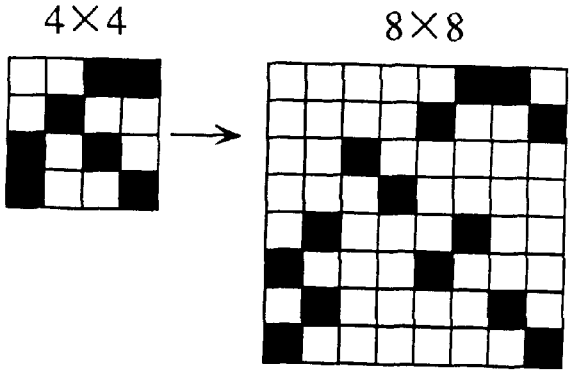

That is, in the option "創作小 柄" (creative small pattern), in correspondence to each horizontal row of image-forming dots of the source image data, image-expanding dot sets each corresponding to either an image-forming dot of the source image data on an odd-numbered or even-numbered column thereof are arranged such that a herringbone pattern of image-forming dots is formed. For example, when an image-forming dot data item in 4×4 dots as shown in a left side portion of FIG. 17B is available, there is formed image data obtained by expanding the image-forming dot data item into a size of 8×8 dots which is four times as large as the size of the source data.

Then, the resulting image data item expanded as described above is arranged as unit background pattern image data items to form background pattern print image data (S731 in FIG. 8), on which the subject writing character string print image data, e.g. one formed in the "創作小 柄" (creative small pattern) is superimposed to form image pattern data at the step S9 in FIG. 4, which is then printed at the step S10 in FIG. 4 to dress a colored tape or the like.

Figure 19A:
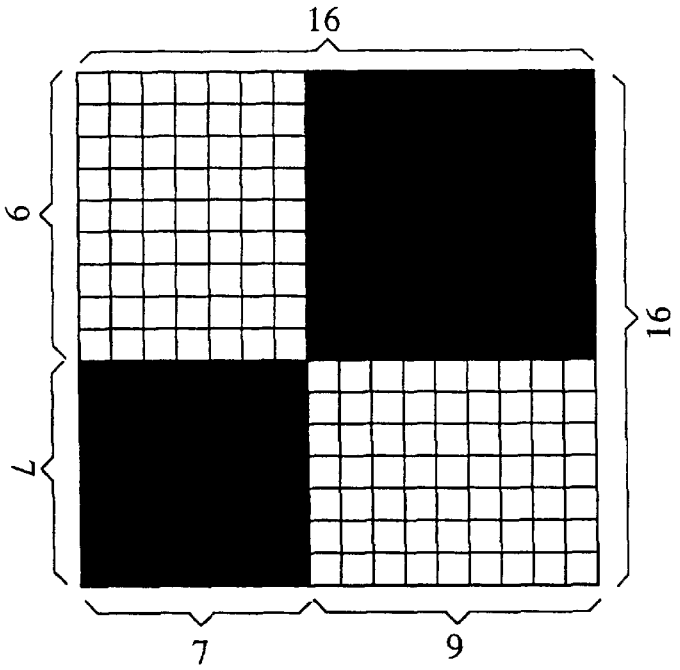
FIG. 19A is a diagram showing an example of unit background pattern tile used when the option "創作小柄" (creative small pattern) shown in FIGS. 17A and 17B is designated.
Figure 19B:
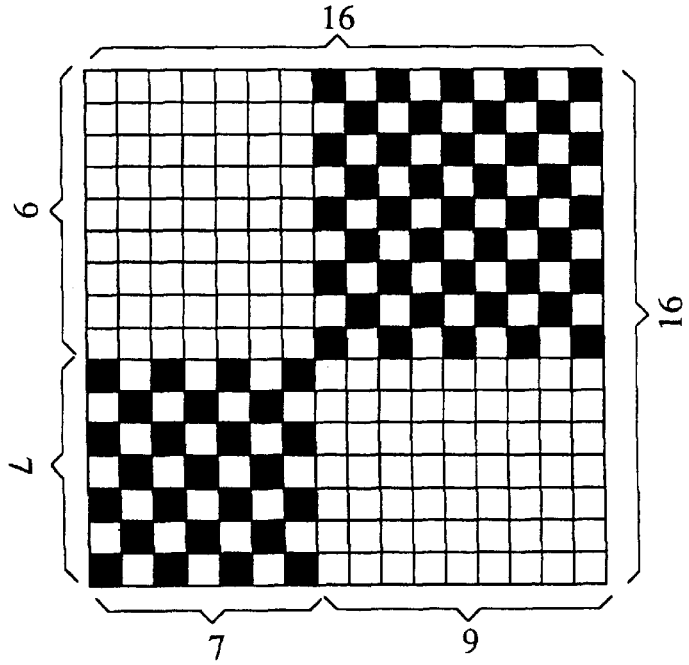
FIG. 19B is a diagram showing an example of unit background pattern tile used when the option "創作大柄" (creative large pattern) shown in FIGS. 18A and 18B is designated.
Figure 20A:
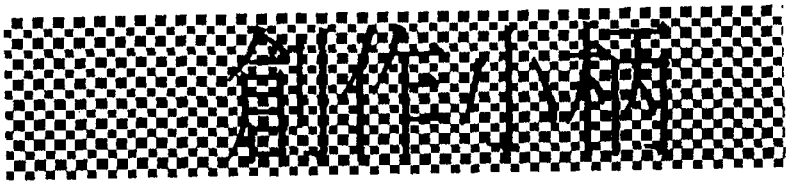
FIG. 20A shows an example of results of printing of a background pattern carried out when the FIG. 17A "創作小柄" (creative small pattern) option is applied to the FIG. 19A unit background pattern tile.
Figure 20B:
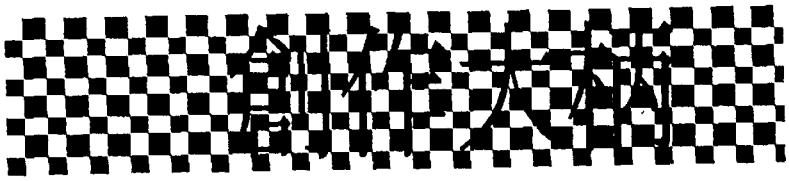
FIG. 20B shows an example of results of printing of a background pattern carried out when the FIG. 18A "創作大柄" (creative large pattern) option is applied to the FIG. 19A unit background pattern tile.
Figure 20C:
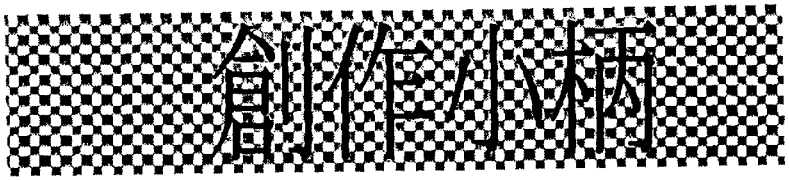
FIGS. 20C shows an example of results of printing of a background pattern carried out when the FIG. 17A "創作小柄" (creative small pattern) option is applied to the FIG. 19B unit background pattern tile.

For example, assuming that by designating the option "創作小 柄" (creative small pattern) defined as described above in the unit background pattern-designating/creating processing described above (see screens T81 to T82 in FIG. 13 or 15), and selecting "外字" (nonstandard character) (on the screen T83-T84 in FIG. 13), a unit background pattern image data item in 16×16 dots as shown in FIG. 19B is formed, it is possible to obtain a tape T dressed by background a pattern printing as shown in FIG. 20A or 20C.

In this case, compared with a case in which unit background tile in 16×16 dots as shown in FIG. 19A is directly utilized as the background pattern image data, the printed image by the option "創作小 柄" (creative small pattern) is equivalent to a unit background pattern having a fourfold size. Further, the ratio of the number of total image-forming dots to the number of total dots of a background pattern print image is reduced by half, so that as a whole, a light but dressed-up graphical property can be imparted thereto, whereby it is possible to favorably vary the appearance of the background pattern of the tape T.

In the above case, the unit background pattern tile in FIG. 19A can be formed by filling an upper right area of 9×9 dots and a lower right area of 7×7 dots of the whole area of 16×16 dots with black dots by selecting the option 2 "黒塗" (black filling)on the screen T85 in FIG. 13, and FIG. 20A shows an example of results of background pattern printing carried out by the use of this data. Further, the unit background pattern tile shown in FIG. 19B can be formed by reversing black dots of areas filled with black dots in diagonal direction by selecting the option 1 "普通" (normal filling), and corresponds to FIG. 20C.

Figure 18A:
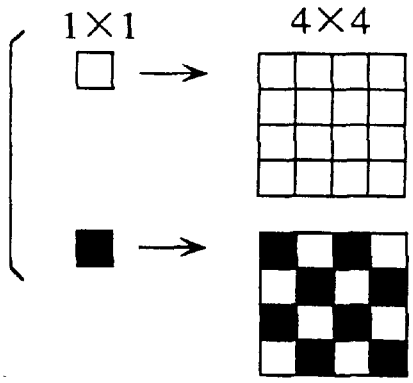
FIGS. 18A and 18B are diagrams which are useful in explaining a manner of forming unit background pattern image data, when the option "創作大柄" (creative small pattern) is designated from the menu of "創作地紋" (creative background pattern)
Figure 18B:
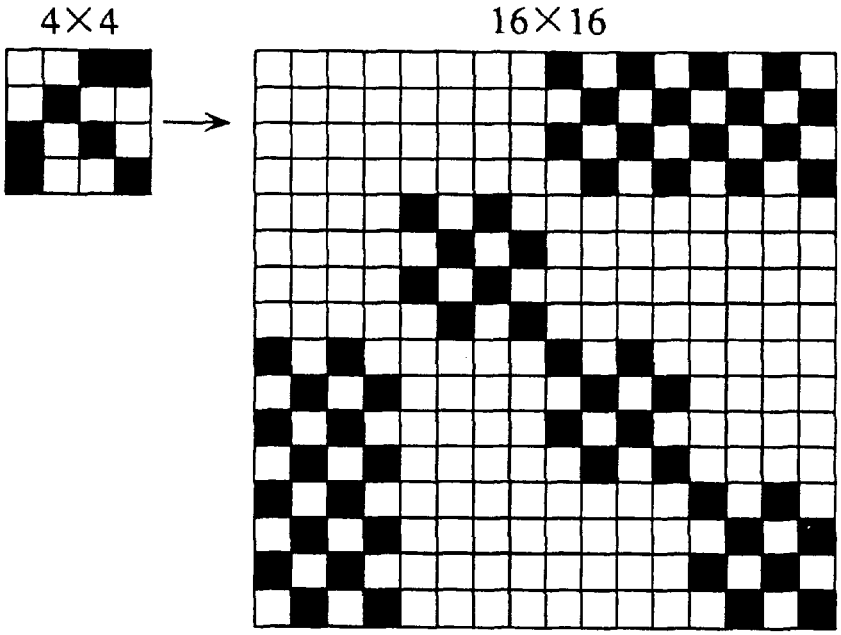

Next, in the unit background pattern creation (S729) in FIG. 8 executed when the option "創作大 柄" (creative large pattern) is selected in the unit background pattern-designating/creating processing, as shown in FIG. 18, in correspondence to each blank dot in 1×1 dot, an expanded blank dot set in 4×4 dots is arranged, and in correspondence to each image-forming dot in 1×1 dot, an expanded image-forming dot set in which an image-forming dot and a blank dot are arranged alternately, i.e. in the form of a check pattern is arranged. For example, as part of the unit background pattern tile, if an image-forming dot data item in 4×4 dots as shown in a left side portion of FIG. 18B (identical with an example shown in FIG. 17B) is available, there is formed an image data item obtained by expanding the image-forming dot data item into a size of 16×16 dots which is sixteen times as large as the size of the source data.

For example, assuming that by designating the option "創作大 柄" (creative large patterns) defined as described above in the unit background pattern-designating/creating processing (see screens T81 to T82 in FIG. 15), and selecting "外字" (nonstandard character) (on T83-T84 in FIG.

Figure 20D:
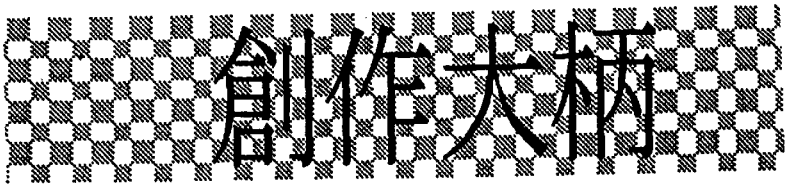
FIG. 20D shows an example of results of printing of a background pattern carried out when the FIG. 18A "創作大柄" (creative large pattern) option is applied to the FIG. 19B unit background pattern tile.

13), a unit background pattern image data item in 16×16 dots as shown in FIG. 19B (identical with the example of the option "創作小柄" (creative small pattern) is formed, it is possible to obtain a tape T dressed by background pattern printing as shown in FIG. 20B or 20D. FIG. 20B shows an example of a background pattern print using the unit background pattern tile shown in 19A, while FIG. 20D shows an example of a background pattern print using the background pattern tile shown in FIG. 19B. In this case, compared with cases in which the unit background tiles in 16×16 dots as shown in FIGS. 19A and 19B are directly utilized as the background pattern image data, the printed images are equivalent to printed images obtained by arranging respective unit background patterns each having a sixteen-fold size. Further, the ratio of the number of total image-forming dots to the number of total dots is reduced by half, so that, as a whole, a light but dressed-up graphical property can be imparted thereto, whereby it is possible to favorably vary appearance of the background pattern of the tape T.

As described above, when the option "創作拡大" (creative expansion) is designated at level 3 under the option "創作地紋" (creating background pattern) at level 2 in FIG. 9, i.e. when the option "創作小柄" (creative small pattern) or the option "創作大柄" (creative large pattern) is designated, one kind of unit background pattern image data can be selected or created as a unit background pattern tile, and an expanded image-forming dot set in which a plurality of image-forming dots are arranged in predetermined directions is arranged in a manner corresponding to each image-forming dot of the unit background pattern tile, whereby it is possible to obtain a new unit background pattern image data item which is varied in density or size. By forming and printing the background pattern printing image data through arrangement or juxtaposition of the new unit background pattern image data, a background pattern print which is light, as a whole, is formed, whereby it is possible, for example, to clearly present subject writing character strings against the background.

Next, the option "創作配置" (creative arrangement) of the unit background pattern-selecting/creating processing, which is selected from the menu at level 3 in FIG. 9, will be described. In the option "創作配置" (creative arrangement), one kind of unit background pattern image data is selected or created as a unit background pattern tile, and one kind of unit background pattern image data is selected or created as an arrangement-specifying matrix for specifying the arrangement of unit background pattern tiles. That is, by selecting an option "創作単位" (creative unit) at level 4 under the option "創作配置" (creative arrangement) shown in FIG. 9, a unit background pattern image data item selected from the menu subsequent thereto is converted to a unit background pattern tile, and when an option "創作指定" (creative designation) is selected at level 4, a unit background pattern image data item selected or created in the menu subsequent thereto is converted to an arrangement-specifying matrix.

Figure 6A:
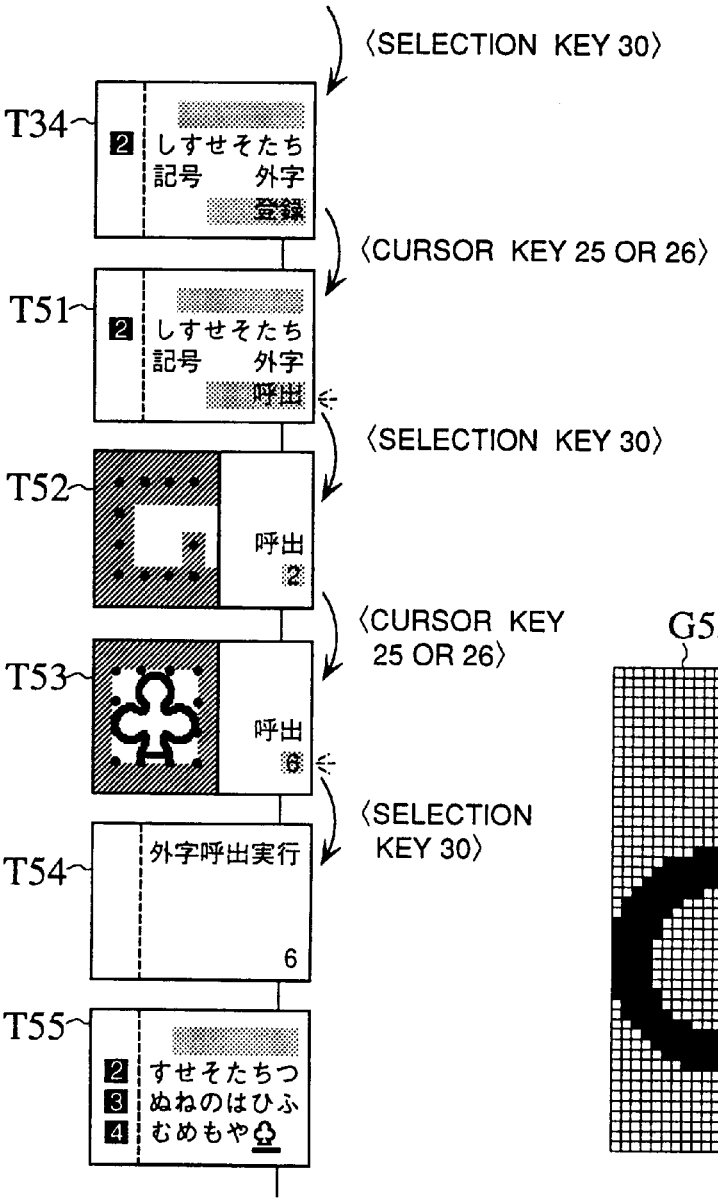
FIG. 6A is a diagram showing examples of contents displayed on the screen, which are useful in explaining processing for calling of a nonstandard character which is executed during symbol/nonstandard character input processing in the FIG. 4 control processing.
Figure 6B:
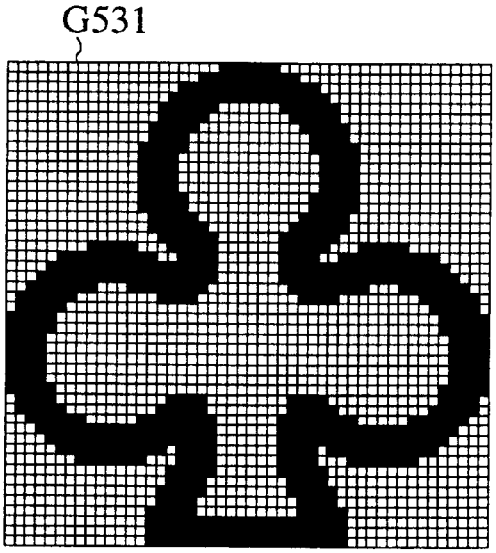
FIG. 6B is an expanded view of an image of the nonstandard character called by the FIG. 6A processing.

As an example, when the option "創作単位" (creative unit) is designated in the unit background pattern-designating/creating processing (see tables corresponding to screens T81 and T82 in FIG. 15), and similarly to the screen T89 in FIG. 13, "名前10" (name 10) under which the image G531 shown in FIG. 6 is registered as the unit background pattern data is selected from the menu presented at level 5 in FIG. 9, the image G531 of the three-leafed figure is first displayed on a screen of 48×48 dots. After this image is transformed into one on a screen of 32×32 dots, and then determined as a unit background pattern data item, the unit background pattern image data of the three-leafed figure is converted or set to the unit background pattern tile.

Figure 21A:
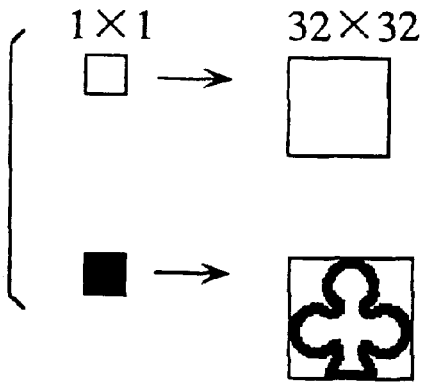
FIGS. 21A and 21B are diagrams which are useful in explaining a manner of forming unit background pattern image data, when the option "創作配置" (creative arrangement) is designated from the menu of "創作地紋" (creative background pattern)

In this case, assuming that after the arrangement-specifying matrix is selected or created by the option "創作指定" (creative designation), the unit background pattern-designating/creating processing is terminated, and the format-selecting/designation (S71 in FIG. 7) is terminated, in the unit background pattern creation (S729 in FIG. 8) of the background pattern print image-forming processing (S72 in the FIG. 7), as shown in FIG. 21, in correspondence to each blank dot set in 1×1 dot in the arrangement-specifying matrix, an expanded blank dot set in 32×32 dots is arranged, and in correspondence to each image-forming dot set in 1×1 dot, a unit background pattern tile in 32×32 dots (of the image G531 representative of the three-leafed figure) is arranged.

Figure 21B:
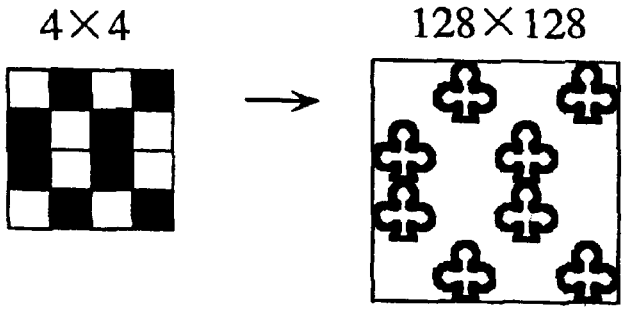

In the above case, if unit background pattern image data in 4×4 dots as shown in a left side of FIG. 21B is formed by designating the option "創作指定" (creative designation) in the unit background pattern-designating/creating processing (see tables corresponding to the screens T81 to T82 in FIG. 15), and selecting "外字" (nonstandard character), the unit background pattern image data is used as the arrangement-specifying matrix in the unit background pattern creation in FIG. 8 (S729),and a unit background pattern image data item in 128×128 dots as shown in FIG. 21B can be formed.

In this case, if the plotting in 4×4 dots is difficult to execute due to a small plotting area in the plotting screen on the screen T85 in FIG. 13, a unit background pattern image data item in 16×16 dots may be formed in the 16×16 dot display screen, which is similar to an expansion of a left side portion of FIG. 21B, i.e. in which image-forming dot sets are each formed of a black-filled area in 4×4 dots. Then, this unit background pattern image data item may be transformed or developed into a 4×4 dot screen, and then determined by depressing the selection key 30.

Figure 21C:
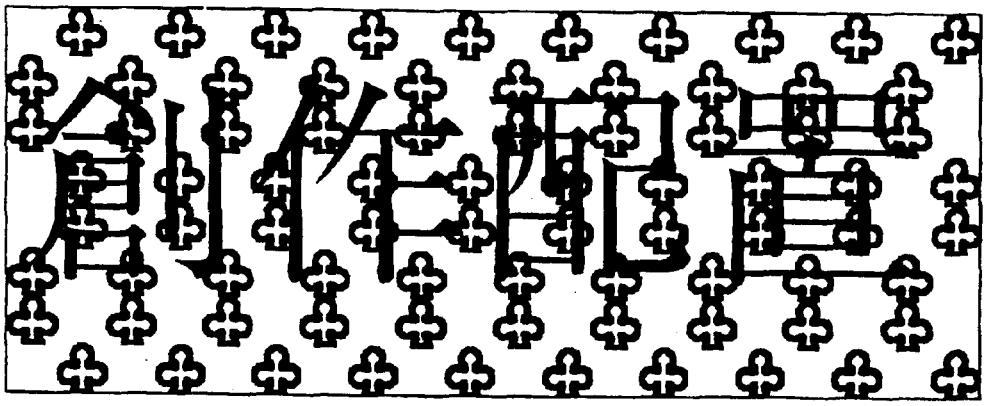
FIG. 21C shows an example of results of printing of a background pattern carried out using the unit background pattern image data formed in the manner explained with reference to FIGS. 21A and 21B.

Then, upon termination of the unit background pattern-designating/creating processing, the unit background pattern image data is arranged or juxtaposed (S731 in FIG. 8). On the unit background pattern image data, subject writing character string print image data representative of kanji characters e.g. of "創作配置" is superimposed (S9 in FIG. 4), and the resulting data is printed (S10 in FIG. 4), whereby it is possible to obtain a tape T dressed as shown in FIG. 21C.

As described above, under the option "創作地紋" (creative background pattern) selected at the menu at level 2 in FIG. 9, after designating the option "創作配置" (creative arrangement) in the menu presented at level 3, the option "創作指定" (creative designation) is designated at level 4 to select or create one kind of unit background pattern image data as an arrangement-specifying matrix, and the option "創作単位" (creative unit) is designated to select or create one kind of the unit background pattern image data as the unit background pattern tile. Then, the unit background pattern tile is arranged in a manner corresponding to the arrangement of image-forming dots of the arrangement-specifying matrix, whereby it is possible to form a variety of new items of unit background pattern image data. For example, when the arrangement-specifying matrix is defined by data of dotted image as described above, it is possible to set the arrangement or juxtaposition of unit background pattern tiles freely or as desired. That is, by selecting data of a unit background tile of a desired pattern, and designating the arrangement of unit background tiles by the use of an arrangement-designating matrix, freely or as desired, it is possible to dress a background pattern with a degree of freedom by far higher than using conventional methods.

Next, an option "創作A型" (creative type A) of the unit background pattern-designating/creating processing, which is selected from the menu at level 3 in FIG. 9, will be described. In the option "創作A型" (creative type A), as well as in an option "創作B型"(creative type B) and an option "創作C型" (creative type C), both described hereinafter, one kind or a plurality of kinds of unit background pattern image data are selected or created to form one kind of unit background pattern tile.

Figure 22A:
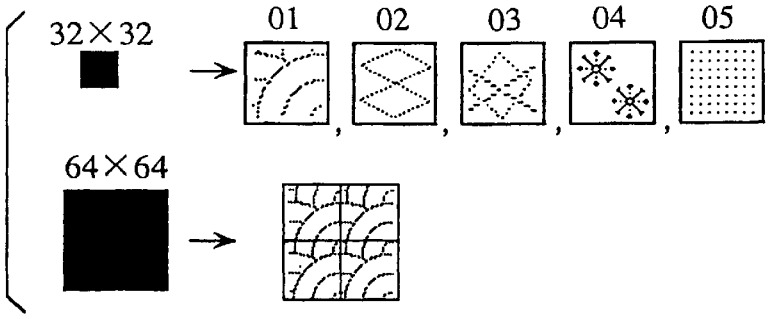
FIG. 22A is a diagram which is useful in explaining a manner of forming unit background pattern image data, when the option "創作A型" (creative type A) is designated from the menu of "創作地紋" (creative background pattern)

The option "創作A型" (creative type A) is the most fundamental type of the "創作地 紋" creative background patterns. For example, when the option "創作A型" (creative type A) is designated by the unit background pattern-designating/creating processing (see tables corresponding to screens T81 and T82 in FIG. 15), and "外字" (nonstandard character) is selected, it is possible to form or create various kinds of unit background pattern image data items in 32×32 dots, as shown in FIG. 22A (five kinds are shown in the figure). These data items are used as unit background pattern tiles in the unit background pattern creation (S729) in FIG. 8, to directly form the unit background patter image data. In the following description, it is assumed that the above five kinds of unit background pattern data have "名前01" (name 01) to "名前05" (name 05), respectively, as shown in the figure.

Figure 23A:
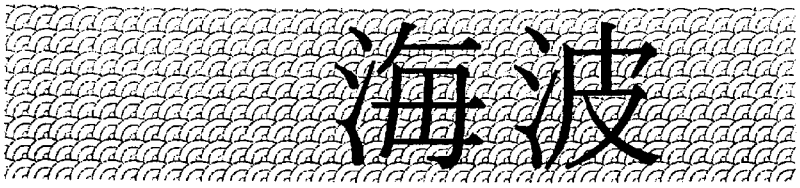
FIGS. 23A to 23E show examples of results of printing of a background pattern carried out using unit background pattern image data formed by the FIG. 22A option "創作A型" (creative type A)
Figure 23B:
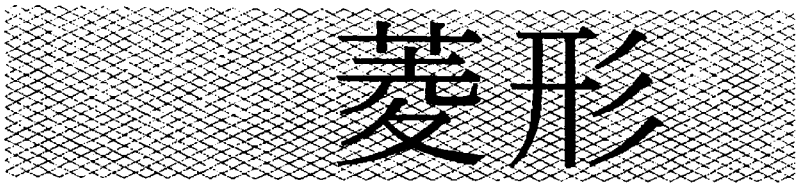
Figure 23C:
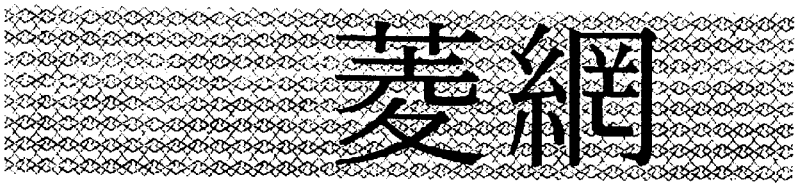
Figure 23D:
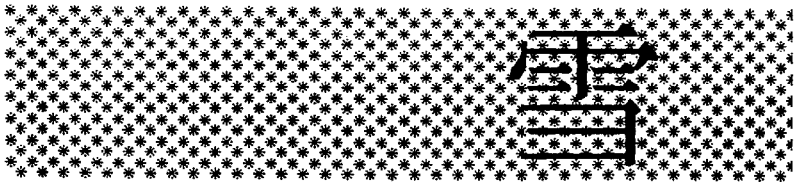
Figure 23E:
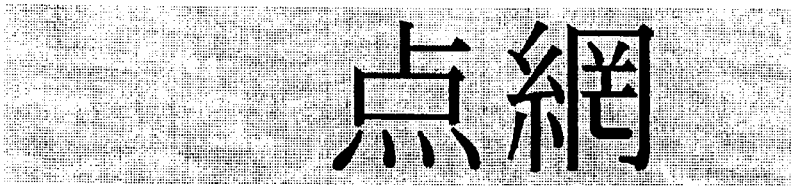

For example, when the option "創作A型" (creative type A) is designated to form the unit background pattern data of the above "名前01" (name 01), and the unit background pattern-designating/creating processing is terminated, unit background pattern image data is formed by arranging or juxtaposing the unit background pattern image data (S731 in FIG. 8). That is, if an area of 64×64 dots is considered as part of the background pattern image data, it is arranged as shown in a lower portion of FIG. 22A. If subject writing character string print image data of kanji characters "海波" is superimposed thereon (S9 in FIG. 4), and the resulting data is printed (S10 in FIG. 4), there is formed a tape T as shown in FIG. 23A. Similarly, if the unit background pattern image data of "名前02" (name 02) in FIG. 22A is formed and subject writing character string of kanji characters "菱形" is entered, it is possible to obtain a tape T as shown in FIG. 23B. Similarly, in a manner corresponding to the "名前03" (name 03) to "名前05" (name 05) in FIG. 22A, notational character stings of kanji characters "菱網", "雪", and "点網" are entered, and items of the resulting print image data are printed, it is possible to obtain tapes T as shown in FIGS. 23C to 23E, respectively.

Next, the option "創作B型" (creative type B) of the unit background pattern-designating/creating processing, which is selected from the menu at level 3 in FIG. 9, will be described. In the option "創作B型" (creative type B), two kinds of unit background pattern image data are selected or created to form one kind of unit background pattern tile. For example, after the option "創作B型" (creative type B) is designated at level 3 in the unit background pattern-designating/creating processing, and an option "創作左側" (creative left side) is designated at level 4 in the same (see tables corresponding to the screens T81 and T82 in FIG. 15), a unit background pattern image data item of "★" corresponding to "●" in FIG. 22B (having the name of "名前06" (name 06) is selected or formed. In this case, if the background pattern image data item of "★" is not available as a ready-made unit background pattern, "外字" (nonstandard character) may be selected to carry out plotting entry, whereas if the same is available, the ready-made unit background pattern image data item is called for selection or designation. Next, similarly, at level 4, an option "創作右側" (creative right side) is selected (also see tables of FIG. 16), and then a unit background pattern image data item of "☆" corresponding to "○" in FIG. 22B (having the name of "名前07" (name 07) is selected or formed.

Figure 22B:
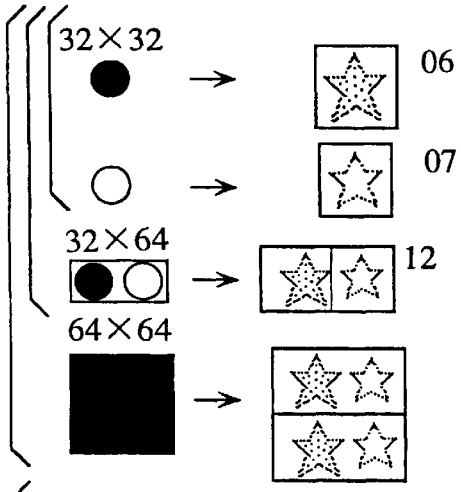
FIG. 22B is diagram which is useful in explaining a manner of forming unit background pattern image data, when the option "創作B型" (creative type B) is designated from the menu of "創作地紋" (creative background pattern)
Figure 24A:
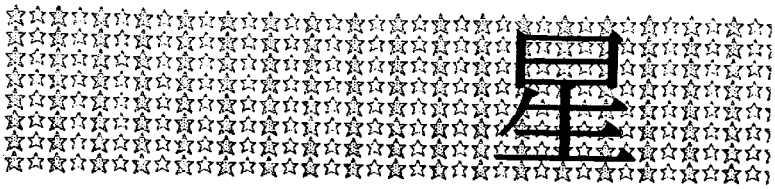
FIG. 24A shows an example of results of printing of a background pattern carried out using unit background pattern image data formed by the FIG. 22B option "創作B型" (creative type B)
Figure 24B:
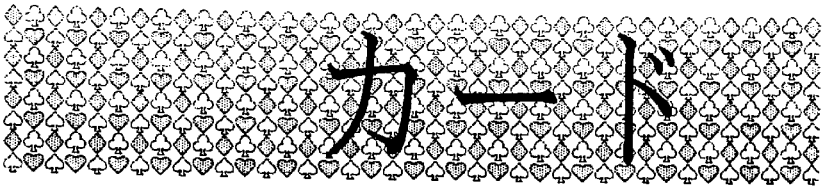
FIGS. 24B to 24D show examples of results of printing of a background pattern carried out using items of unit background pattern data formed by the FIG. 22C option "創作C型" (creative type C)

These two kinds of data items are used as unit background pattern tiles in the unit background pattern creation (S729) in FIG. 8, to directly form a unit background patter image data item in 32×64 dots as shown in FIG. 22B, in which there tiles are arranged horizontally adjacent to each other. That is, when the unit background pattern-designating/creating processing is terminated after designating the above two unit background pattern image data items, the background pattern print image data in which the two kinds of the unit background pattern image data are arranged as shown in a lower portion of FIG. 22B (S731 in FIG. 8). On this background pattern print image data, subject writing character string print image data of a kanji character "星" is superimposed, and the resulting print image data is printed to form a tape T as shown in FIG. 24A.

Finally, the option "創作C型" (creative type C) of the unit background pattern-designating/creating processing, which is selected from the menu at level 3 in FIG. 9, will be described. In the option "創作C型" (creative type C), four kinds of unit background pattern image data are selected or created to form one kind of unit background pattern tile. The following description will be made with reference to FIG. 22C, assuming that four kinds of unit background pattern image data shown in respective upper portions in FIG. 22C are named "名前08" (name 08) to "名前11" (name 11).

Figure 22C:
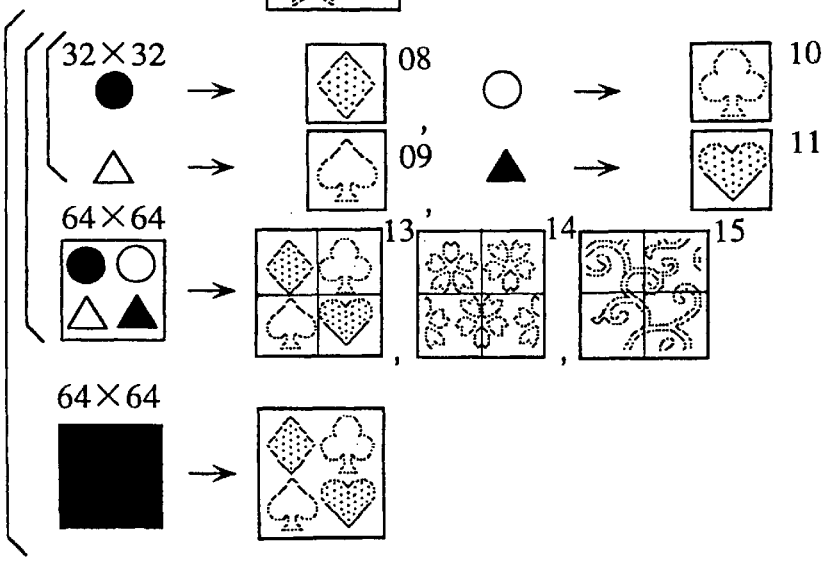
FIG. 22C is a diagram which is useful in explaining a manner of forming unit background pattern image data, when the option "創作C型" (creative type C) is designated from the menu of "創作地紋" (creative background pattern)

For example, after the option "創作C型" (creative type C) is designated at level 3 in the unit background pattern-designating/creating processing, and an option "創作左上" (creative upper left) is designated at level 4 in the same (see tables in FIG. 16 corresponding to the screens T81 and T82 in FIG. 15), a unit background pattern image data item of "◆" (having the name of "名前08" (name 08)) corresponding to an item "●" in FIG. 22C is selected or formed. Similarly, a unit background pattern image data item of a figure of clubs (three-leafed figure) having the name of "名前10" (name 10) is formed by selecting an option "創作右上" (creative upper right), a unit background pattern image data item of a figure of spade having the name of "Name 09" by selecting an option "創作左下" (creative lower left), and a unit background pattern image data item of a figure of heart having the name of "名前11" (name 11) by selecting an option "創作右下" (creative lower right).

Figure 24C:
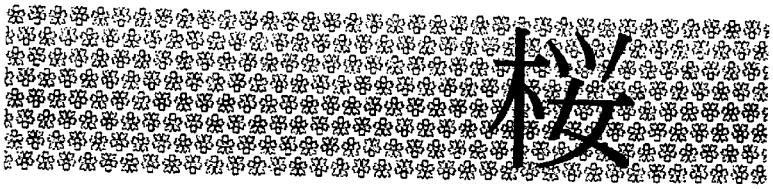

These four kinds of data items are used as unit background pattern tiles in the unit background pattern creation (S729) in FIG. 8, to directly form a unit background patter image data item of 64×64 dots named "名前13" (name 13) as shown in FIG. 22C, in which the four kinds of tiles are arranged at respective upper left, upper right, lower left and lower right portions of the figure. That is, when the unit background pattern-designating/creating processing is terminated after designating the above four kinds of the unit background pattern image data, a background pattern print image data item in which the four kinds of the unit background pattern image data are arranged in 64×64 dot areas of the background pattern image data (S731 in FIG. 8). On this background pattern print image data, subject writing character string print image data of a Japanese hirakana character "カード" is superimposed (S9 in FIG. 4), and the resulting print image data is printed (S10 in FIG. 4) to form a tape T as shown in FIG. 24C.

As described above, under the option "創作地紋" (creative background pattern) selected at the menu at level 2 in FIG. 9, by designating the "創作B型" (creative type B) or the "創作C型" (creative type C) at level 3, and selecting or creating a plurality of kinds of unit background pattern image data as unit background pattern tiles, a new additional kind of unit background pattern image data as a combination of these unit background pattern tiles can be created. That is, it is possible to form new additional unit background pattern image data items as a variety of combinations of unit background pattern data items, and hence various kinds of background pattern print image data abundant in variation can be formed. Therefore, the tape printing apparatus is capable of providing background pattern prints rich in variety.

Figure 24D:
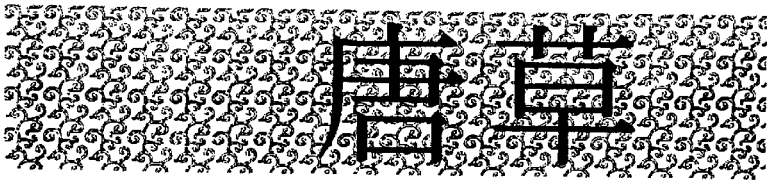
Figure 25:
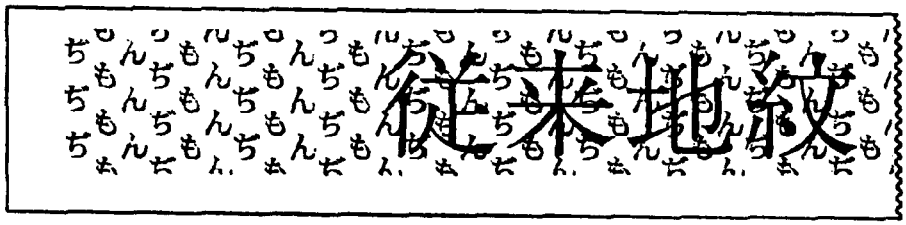
FIG. 25 is a diagram showing an example of results of printing of a background pattern carried out in a conventional manner.

For example, by designating the option "創作C型" (creative type C), and selecting or forming four kinds of unit background pattern image data in 32×32 dots as the background pattern tiles, it is possible to form a unit background pattern image data item which has a complicated pattern, such as items of unit background pattern image data in 64×64 dots named "名前14" (name 14) and "名前15" (name 15), respectively as shown in FIG. 22C. When print image data formed by the use of these data items having "名前14" (name 14) and "名前15" (name 15), and by entering a kanji character "桜" and kanji characters "唐草" as respective subject writing character strings, tapes as shown in FIGS. 24C and 24D can be obtained.

As described above, according to the background pattern print image-forming method and device, by storing a plurality of kinds of unit background pattern image data, it is possible to select one of them as a designated unit background pattern image data item as desired to thereby form background pattern print image data representative of desired background patterns, which is formed of copies of the designated unit background pattern image data item. Therefore, the tape-printing apparatus 1 to which the method and device is applied is capable of printing against a desired background pattern thus formed.

The invention is not necessarily limited to the above embodiments, but can be carried out or put into practice in various ways.

For example, although in the above embodiments, as to the method of forming and storing unit background pattern image data, description is made mainly of the method of forming unit background pattern image data constituting a desired background pattern, by the use of input means for describing a picture as a dotted image, which implements the function of what is called nonstandard character registration, and storing the data in a RAM 60 or the like, this is not limitative, but during the process of manufacturing printing apparatuses, various types of standard unit background pattern image data items representative of popular patterns may be formed and stored in the ROM or the like. This will enable these items of standard unit background pattern image data to be utilized when a new item of unit background pattern image data is formed.

Further, although in the FIG. 4 flowchart of overall processing, depression of each member of the function key group is determined sequentially, but this is not limitative, but an individual interrupt may be generated whenever each function key is depressed, whereby event-responsive processing may be carried out by interrupt handling processing. This makes it possible to omit the step of determining depression of other keys, thereby improve response of the system to each key entry.

Still further, although in the option "創作拡大" (creative expansion) described hereinabove, in a manner corresponding to each unit of 1×1 dot, an expanded image-forming dot set of 2×2 dots is arranged for the option "創作小柄" (creative small pattern), and an expanded image-forming dot set of 4×4 dots for the option "創作大柄" (creative large pattern), this is not limitative, but other expanded image-forming dot sets may be employed. The expanded image-forming dot set may have a variety of sizes, including 3×3 dots, 3×2 dots, 4×5 dots, and 16×6 dots. The arrangement of image-forming dots may be set as desired, according to requirements.

Even further, in the above cases, by additionally providing menu options named suitably, such as a creative medium pattern option, and a creative very large pattern option, in the menu of the creative expansion at level 4, it is possible to select such expanded image-forming dot set, similarly to the option "創作小柄" (creative small pattern) and the option "創作大柄" (creative large pattern). Further, if the device is configured such that an expanded image-forming dot set, in which four dots of 2×2 dots are all set to image-forming dots, can be selected, a new item of unit background pattern image data which is only changed in size, i.e. expanded to a size four times as large as the original size, can be formed.

Further, in the above option "創作配置" (creative arrangement), both the arrangement-designating matrix and the unit background tile (ground design) tile are designated after the menu options of "創作指定" (creative designation) and "創作単位" (creative unit) are selected, this is not limitative, but the device may be configured such that when one of them is designated, the screen may be automatically changed to a screen for the other. Further, when only one of them is designated, one designated on the immediately preceding occasion may be selected or the ready-made background pattern image data accessed last time may be selected, as the other unit background pattern image data item. Further, it may be set such that ready-made background pattern image data having "名前01" (name 01) is selected.

Further, although in the former examples, the arrangement-designating matrix is defined by the use of a dotted image, this is not limitative, but it goes without saying that unit background pattern image data of the ready-made background pattern may be selected or modified for defining the arrangement-designating matrix. In this case, by selecting a unit background pattern image data item of a complicated pattern for defining the arrangement-designating matrix, it is possible to form a unit background pattern image data item of an even more complicated image according to the complicated pattern.

Further, although in the option "創作B型" (creative type B), two kinds of unit background pattern image data are horizontally juxtaposed to form a new background pattern image data item, this is not limitative, but the two data kinds of data may be vertically juxtaposed, or the direction of juxtaposition may be permitted to be selected.

Further, in the option "創作B型" (creative type B) and the option "創作C型" (creative type C), two or four required kinds of unit background pattern image data are selected or formed after selecting one of the options of designating the option "創作B型" (creative type B) or the option "創作C型" (creative type C), and then printing is carried out, this is not limitative, but, similarly to the case of the option "創作配置" (creative arrangement), if any of the required kinds of unit background pattern image data is not designated, a data item designated on the immediately preceding occasion, a ready-made unit background pattern image data item used last time, or a unit background pattern image data item set by default may be permitted to be selected, or the screen may be automatically switched to another selecting/designating screen.

It is further understood by those skilled in the art that the foregoing are preferred embodiments of the invention, and that various changes and modification may be made without departing from the spirit and scope thereof.

What is claimed is:

1. A background pattern print image-forming method, which comprises the steps of:

storing a plurality of kinds of unit background pattern image data formed of a dot matrix which defines a group of image-forming dots representative of a unit printing portion of a background pattern to be printed on a printing object, in a memory device;

selecting one kind of unit background pattern image data from said plurality of kinds of unit background pattern image data stored in said memory device, as a unit background pattern tile;

reading said selected unit background pattern tile from said memory device, and modifying said unit background pattern tile read from said memory device to thereby form a different kind of unit background pattern image data from said selected one kind of unit background pattern image data; and arranging said different kind of unit background pattern image data in a manner such that said background pattern is formed, to thereby form background pattern print image data.

2. A background pattern print image-forming method according to claim 1, further including the step of forming said unit background pattern image data based on dot image data entered.

3. A background pattern print image-forming method according to claim 1, wherein said step of forming said different kind of unit background pattern image data includes the step of extracting a portion of said unit background pattern tile to thereby form said different kind of unit background pattern image data.

4. A background pattern print image-forming method according to claim 1, wherein said step of forming said different kind of unit background pattern image data includes the step of reading said unit background pattern tile from said memory device by the use of an image-expanding dot set formed of a dot matrix consisting of a plurality of image-forming dots arranged in at least one of a vertical direction, a horizontal direction, and a diagonal direction, and remaining dots arranged as blank dots, thereby arranging said image-expanding dot set in a manner corresponding to an arrangement of image-forming dots of said unit background pattern tile to thereby form said different kind of unit background pattern image data.

5. A background pattern print image-forming method according to claim 4, wherein said image-expanding dot set comprises image-forming dots and blank dots arranged in a manner alternating with each other in a column and/or in a row.

6. A background pattern print image-forming method according to claim 4, wherein by the use of two kinds of dot matrices of an odd-numbered column image-expanding dot set in which image-forming dots are arranged diagonally from an upper right location to a lower left location and an even-numbered column image-expanding dot set in which image-forming dots are arranged diagonally from an upper left location to a lower right location, said odd-numbered column image-expanding dot set is arranged in a manner corresponding to each of image-forming dots on each odd-numbered column of said unit background pattern tile, and said even-numbered column image-expanding dot set is arranged in a manner corresponding to each of image-forming dots on each even-numbered column of said unit background pattern tile, thereby forming said different kind of unit background pattern image data.

7. A background pattern print image-forming method according to claim 1, wherein said step of storing said different kind of unit background pattern image data includes the steps of:

selecting one kind of unit background pattern image data from said plurality of kinds of unit background pattern image data stored in said memory device, as an arrangement-designating matrix; and arranging said unit background pattern tile in a manner corresponding to a location of each of image-forming dots of said arrangement-designating matrix to thereby form said different kind of unit background pattern image data.

8. A background pattern print image-forming device, comprising:

unit background patter-storing means for storing a plurality of kinds of unit background pattern image data formed of a dot matrix which defines a group of image-forming dots representative of a unit printing portion of a background pattern to be printed on a printing object, in a memory device;

unit background patter-designating means for selecting one kind of unit background pattern image data from said plurality of kinds of unit background pattern image data stored in said memory device, as a unit background pattern tile;

unit background pattern image-forming means for reading said selected unit background pattern tile from said memory device, and modifying said unit background pattern tile read from said memory device to thereby form a different kind of unit background pattern image data from said selected one kind of unit background pattern image data; and background pattern print image-forming means for arranging said different kind of unit background pattern image data in a manner such that said background pattern is formed, to thereby form background pattern print image data.

9. A background pattern print image-forming device according to claim 8, including entry/creating means for forming said unit background pattern image data based on dot image data entered.

10. A background pattern print image-forming device according to claim 8, wherein said unit background pattern image-forming means includes extraction/creating means for extracting a portion of said unit background pattern tile to thereby form said different kind of unit background pattern image data.

11. A background pattern print image-forming device according to claim 8, wherein said unit background pattern image-forming means includes expansion/creating means for reading said unit background pattern tile from said memory device by the use of an image-expanding dot set formed of a dot matrix consisting of a plurality of image-forming dots arranged in at least one of a vertical direction, a horizontal direction, and a diagonal direction, and remaining dots arranged as blank dots, thereby arranging said image-expanding dot set in a manner corresponding to an arrangement of image-forming dots of said unit background pattern tile to thereby form said different kind of unit background pattern image data.

12. A background pattern print image-forming device according to claim 11, wherein said image-expanding dot set comprises image-forming dots and blank dots arranged in a manner alternating with each other in a column and/or in a row.

13. A background pattern print image-forming device according to claim 11, wherein said expansion/creating means arranges, by the use of two kinds of dot matrices of an odd-numbered column image-expanding dot set in which image-forming dots are arranged diagonally from an upper right location to a lower left location and an even-numbered column image-expanding dot set in which image-forming dots are arranged diagonally from an upper left location to a lower right location, said odd-numbered column image-expanding dot set in a manner corresponding to each of image-forming dots on each odd-numbered column of said unit background pattern tile, and said even-numbered column image-expanding dot set in a manner corresponding to each of image-forming dots on each even-numbered column of said unit background pattern tile, thereby forming said different kind of unit background pattern image data.

14. A background pattern print image-forming device according to claim 8, wherein said unit background pattern image-forming means includes:

arrangement-designating matrix-selecting means for selecting one kind of unit background pattern image data from said plurality of kinds of unit background pattern image data stored in said memory device, as an arrangement-designating matrix; and arrangement-designating/creating means for arranging said unit background pattern tile in a manner corresponding to a location of each of image-forming dots of said arrangement-designating matrix to thereby form said different kind of unit background pattern image data.

15. A background pattern print image-forming method according to claim 1, wherein the step of reading said selected unit background pattern tile from said memory device and modifying said unit background pattern tile read from said memory device to thereby form a different kind of unit background pattern image data includes the step of forming the unit background pattern image data based on dot image data entered by modifying a portion of the unit background pattern tile.

16. A background pattern print image-forming device according to claim 8, wherein the unit background pattern image-forming means includes means for forming the unit background pattern image data based on dot image data entered by modifying a portion of the unit background pattern tile.

17. A background pattern print image-forming device comprising:

a memory device for storing a plurality of kinds of unit background pattern image data formed of a dot matrix which defines a group of image-forming dots representative of a unit printing portion of a background pattern to be printed on a printing object;

desigating apparatus for selecting one kind of unit background pattern image data from said plurality of kinds of unit background pattern image data stored in said memory device, as a unit background pattern tile;

reading apparatus for reading said selected unit background pattern tile from said memory device;

modification apparatus for modifying said unit background pattern tile read from said memory device to form a different kind of unit background pattern image data from said selected one kind of unit background pattern image data; and arranging apparatus for arranging said different kind of unit background pattern image data in a manner such that said background pattern is formed, to thereby form background pattern print image data.

* * * * *